US010678157B2

(12) United States Patent
Watanabe

(10) Patent No.: US 10,678,157 B2
(45) Date of Patent: Jun. 9, 2020

(54) IMAGE FORMING APPARATUS, IMAGE FORMING METHOD AND NON-TRANSITORY COMPUTER-READABLE RECORDING MEDIUM ENCODED WITH IMAGE FORMING PROGRAM

(71) Applicant: KONICA MINOLTA, INC., Tokyo (JP)

(72) Inventor: Yasuji Watanabe, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/502,088

(22) Filed: Jul. 3, 2019

(65) Prior Publication Data

US 2020/0026213 A1 Jan. 23, 2020

(30) Foreign Application Priority Data

Jul. 19, 2018 (JP) ..... 2018-135963

(51) Int. Cl.
*G03G 15/00* (2006.01)
*G03G 15/02* (2006.01)
*G03G 15/01* (2006.01)

(52) U.S. Cl.
CPC ..... *G03G 15/0216* (2013.01); *G03G 15/0105* (2013.01)

(58) Field of Classification Search
None
See application file for complete search history.

(56) References Cited

U.S. PATENT DOCUMENTS

2008/0124159 A1* 5/2008 Oyama ..... G03G 15/6564 399/396
2018/0335744 A1* 11/2018 Nakamura ..... G03G 15/70
2019/0253575 A1* 8/2019 Wei ..... H04N 1/00724
2019/0302668 A1* 10/2019 Hirst ..... G03G 15/5029
2019/0354052 A1* 11/2019 Yoshida ..... G03G 15/5062

FOREIGN PATENT DOCUMENTS

JP 2016102861 A 6/2016

* cited by examiner

*Primary Examiner* — Sevan A Aydin
(74) *Attorney, Agent, or Firm* — Buchanan Ingersoll & Rooney PC

(57) ABSTRACT

An image forming apparatus includes an image former configured to form an image on a recording medium, and a hardware processor, wherein the hardware processor, before the image is formed on the recording medium by the image former, determines a medium type of a subject medium that is the recording medium on which the image is to be formed by the image former, and before the medium type of the subject medium is determined, determines whether an image forming speed at which the image former forms the image is a medium speed that is predetermined with respect to the medium type of the subject medium.

17 Claims, 16 Drawing Sheets

IMAGE FORMING APPARATUS, IMAGE FORMING METHOD AND NON-TRANSITORY COMPUTER-READABLE RECORDING MEDIUM ENCODED WITH IMAGE FORMING PROGRAM

The entire disclosure of Japanese patent Application No. 2018-135963 filed on Jul. 19, 2018, is incorporated herein by reference in its entirety.

BACKGROUND

Technological Field

The present invention relates to an image forming apparatus, an image forming method and a non-transitory computer-readable recording medium encoded with an image forming program. More specifically, the present invention relates to an image forming apparatus that can form images on recording media of different types, an image forming method that is performed in the image forming apparatus and a non-transitory computer-readable recording medium encoded with an image forming program for allowing a computer that controls the image forming apparatus to perform the image forming method.

Description of the Related Art

An image forming apparatus such as an MFP (Multi Function Peripheral) forms images at speeds respectively corresponding to differences in basis weight of sheets. For example, Japanese Patent Laid-Open No. 2016-102861 discloses an image forming apparatus that comprises a first detection means for detecting the surface nature of a recording material, a second detection means for detecting a basis weight of the recording material, and a control means for determining a sheet type of the recording material based on results of detection provided by the first detection means and the second detection means and controlling an image forming operation based on a result of determination, characterized by that the control means, in the case where determining a second speed as a speed at which an image is formed on a first recording medium and a first condition as an image forming condition based on results of detections provided by the first detection means and the second detection means while the first recording material of a plurality of successively conveyed recording materials is conveyed at a first speed, switches a speed at which an image is formed on the first recording material from the first speed to the second speed and forms an image on the first condition, and in the case where determining a second condition as an image forming condition for image formation on a second recording material based on results of detection provided by the first detection means and the second detection means while the second record material is conveyed at the second speed following the first recording material, forms an image on the second condition with the speed at which an image is formed on the second recording material kept at the second speed.

However, in the image forming apparatus described in Japanese Patent Laid-Open No. 2016-102861, the image forming speed is determined after the sheet type of the recording material is determined. Therefore, a predetermined time length is required for the MFP to be capable of forming an image at the determined speed, and a waiting time is generated. Therefore, there is a problem that the throughput is increased by the waiting time.

SUMMARY

According to one aspect of the present invention, an image forming apparatus includes an image former configured to form an image on a recording medium, and a hardware processor, wherein the hardware processor, before the image is formed on the recording medium by the image former, determines a medium type of a subject recording medium on which the image is to be formed by the image former, and before the medium type of the subject medium is determined, determines whether an image forming speed at which the image former forms the image is a medium speed that is predetermined with respect to the medium type of the subject medium.

According to another aspect of the present invention, an image forming method that is performed in an image forming apparatus, wherein the image forming apparatus includes an image former configured to form an image on a recording medium, and the image forming method includes a medium type determining step of, before the image is formed on the recording medium by the image former, determining a medium type of a subject medium that is the recording medium on which the image is to be formed by the image former, and a forming mode determining step of, before the medium type of the subject medium is determined, determining whether to set a medium speed that is predetermined with respect to the medium type of the subject medium as an image forming speed at which the image former forms the image.

According to yet another aspect of the present invention, a non-transitory computer-readable recording medium encoded with an image forming program executed by a computer that controls an image forming apparatus, wherein the image forming apparatus includes an image former configured to form an image on a recording medium, and the computer, before the image is formed on the recording medium by the image former by execution of the image forming program, determines a medium type of a subject medium that is the recording medium on which the image former forms the image, and before the medium type of the subject medium is determined, determines whether to set a medium speed that is predetermined with respect to the medium type of the subject medium as an image forming speed at which the image former forms the image.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
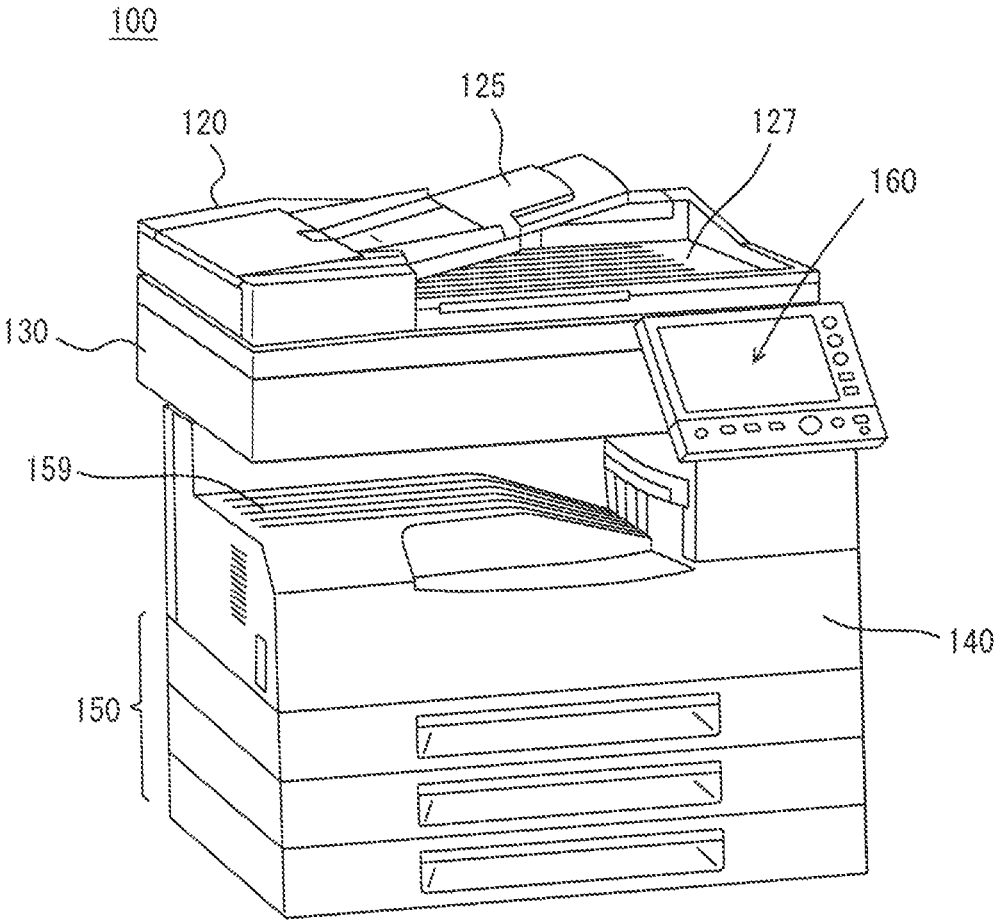
FIG. 1 is a perspective view showing the appearance of an MFP in a first embodiment.

Hereinafter, one or more embodiments of the present invention will be described with reference to the drawings. However, the scope of the invention is not limited to the disclosed embodiments.

An image forming apparatus in embodiments of the present invention will be described below with reference to drawings. In the following description, the same parts are denoted with the same reference characters. Their names and functions are also the same. Thus, a detailed description thereof will not be repeated. Further, in the following description, an MFP is explained as one example of the image forming apparatus. Further, the MFP described below can form an image on any of recording media of a plurality of different medium types. The medium type is the information for differentiating the types of the recording media and includes the information for differentiating basis weights and materials of the recording media. In the case where being made from the same material, which is paper in this case, and having different basis weights, the recording media include a plain paper, a thick paper and a wood free paper. A plain paper has the largest basis weight, followed by a wood free paper and a thick paper, in this order. The materials of the recording media include paper and resin such as PET (Poly Ethylene Terephthalate). The recording media made from resin is an OHP (overhead projector) sheet, for example. In the following description, the material of the recording media is paper, by way of example, unless otherwise specified.

Figure 2:
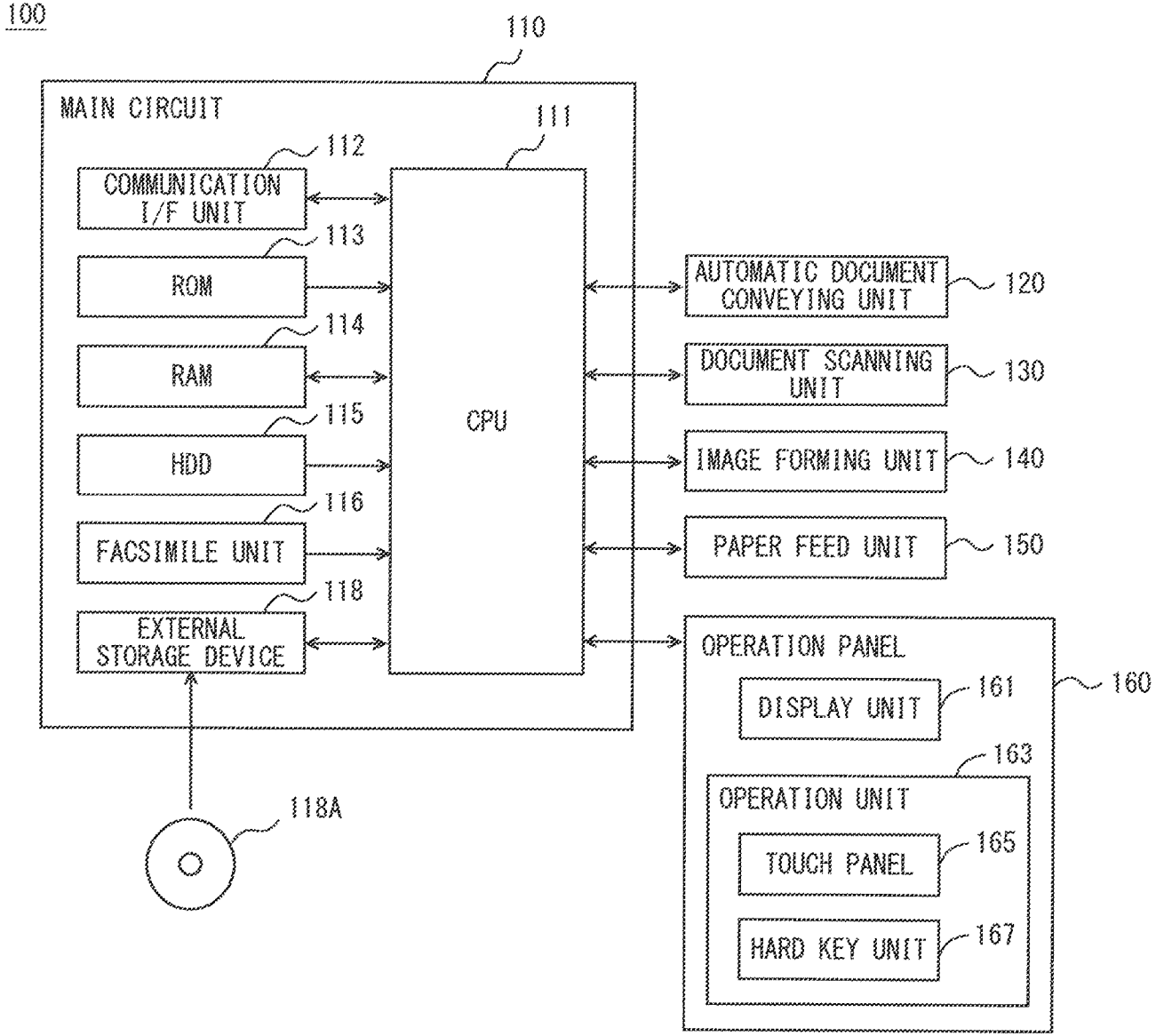
FIG. 2 is a block diagram showing an outline of a hardware configuration of the MFP in the first embodiment.

FIG. 1 is a perspective view showing the appearance of the MFP in a first embodiment. FIG. 2 is a block diagram showing the outline of a hardware configuration of the MFP in the first embodiment. Referring to FIGS. 1 and 2, the MFP 100 is one example of the image forming apparatus, and includes a main circuit 110, a document scanning unit 130 for scanning a document, an automatic document conveying unit 120 for conveying a document to the document scanning unit 130, an image forming unit 140 for forming an image on a recording medium based on image data, a paper feed unit 150 for feeding a recording medium to the image forming unit 140 and an operation panel 160 serving as a user interface.

The automatic document conveying unit 120 automatically conveys a plurality of documents set on a document tray 125 to a document scan position of the document scanning unit 130 one by one, and discharges the document from which a formed image has been scanned by the document scanning unit 130 onto a document discharge tray 127. The automatic document conveying unit 120 includes a document detection sensor for detecting a document placed on the document tray 125.

The document scanning unit 130 has a rectangular scan surface for scanning a document. The scan surface is formed of a platen glass, for example. The automatic document conveying unit 120 is connected to the body of the MFP 100 to be rotatable about an axis parallel to one side of the scan surface, and is openable and closeable. The document scanning unit 130 is arranged below the automatic document conveying unit 120, and the scan surface of the document scanning unit 130 is exposed with the automatic document conveying unit 120 rotated and open. Thus, a user can place a document on the scan surface of the automatic scanning unit 130. The automatic document conveying unit 120 can change between an open state where the scan surface of the document scanning unit 130 is exposed and a close state where the scan surface is covered. The automatic document conveying unit 120 includes a state detection sensor for detecting the open state of the automatic document conveying unit 120.

The document scanning unit 130 includes a light source that emits light and an optoelectronic transducer that receives light, and scans the image formed on a document placed on the scan surface. In the case where the document is placed on a scan region, the light emitted by the light source is reflected from the document, and the reflected light forms an image on the optoelectronic transducer. When receiving the light reflected from the document, the optoelectronic transducer produces image data by converting the received light into an electric signal. The document scanning unit 130 outputs the image data to a CPU 111 included in the main circuit 110.

The paper feed unit 150 conveys the recording media stored in first to third paper feed cassettes and a manual paper feed cassette, described below, to the image forming unit 140. The paper feed unit 150 detects the information about the recording media that are conveyed to the image forming unit 140 as medium information. In the present embodiment, a thin paper, a plain paper, a wood free paper and a thick paper having different basis weights are stored in the paper feed unit 150 as recording media of a plurality of different medium types, by way of example. Therefore, the medium type is the information for differentiating basis weights of paper (sheets of paper).

The image forming unit 140 is controlled by the CPU 111 and forms an image by a well-known electrophotographic technique. In the present embodiment, the image forming unit 140 forms an image on a sheet conveyed by the paper feed unit 150 based on the image data received from the CPU 111. The sheet on which the image is formed is discharged to the paper discharge tray 159. The image data that is output by the CPU 111 to the image forming unit 140 includes image data such as externally received print data in addition to the image data received from the document scanning unit 130.

The main circuit 110 includes the CPU (Central Processing Unit) 111 for controlling the entire MFP 100, a communication interface (I/F) 112, a ROM (Read Only Memory) 113, a RAM (Random Access Memory) 114, a hard disc drive (HDD) 115 that is used as a mass storage device, a facsimile unit 116 and an external storage device 118. The CPU 111 is connected to the automatic document conveying unit 120, the document scanning unit 130, the image forming unit 140, the paper feed unit 150 and the operation panel 160, and controls the MFP 100 as a whole.

The ROM 113 stores a program to be executed by the CPU 111 or data required for execution of the program. The RAM 114 is used as a work area for execution of the program by the CPU 111. Further, the RAM 114 temporarily stores image data successively transmitted from the document scanning unit 130.

The operation panel 160 is provided in an upper part of the MFP 100. The operation panel 160 includes a display unit 161 and an operation unit 163. For example, the display unit 161 is a Liquid Crystal Display (LCD) and displays instruction menus to users, information about the acquired image data and the like. If displaying images, an organic EL (Electroluminescence) display, for example, can be used instead of the LCD.

The operation unit 163 includes a touch panel 165 and a hard key unit 167. The touch panel 165 is a capacitance type. Not only the capacitance type but also another type such as a resistive film type, a surface acoustic wave type, an infrared type and an electromagnetic induction type can be used for the touch panel 165.

The touch panel 165 is provided with its detection surface superimposed on an upper surface or a lower surface of the display unit 161. The size of the detection surface of the touch panel 165 and the size of a display surface of the display unit 161 are the same. Therefore, the coordinate system of the display surface and the coordinate system of the detection surface are the same. The touch panel 165 detects the position designated by the user on the display surface of the display unit 161 using the detection surface, and outputs the coordinates of the detected position to the CPU 111. Because the coordinate system of the display surface and the coordinate system of the detection surface are the same, the coordinates output by the touch panel 165 can be replaced with the coordinates of the display surface.

The hard key unit 167 includes a plurality of hard keys. The hard keys are contact switches, for example. The touch panel 165 detects the position designated by the user on the display surface of the display unit 161. In the case where operating the MFP 100, the user is likely to be in an upright attitude. Thus, the display surface of the display unit 161, the operation surface of the touch panel 165 and the hard key unit 167 are arranged to be directed upward. The user can easily view the display surface of the display unit 161, and the user can give an instruction easily using the operation unit 163 with his or her finger.

The communication unit 112 is an interface for connecting the MFP 100 to the network. The communication I/F unit 112 communicates with another computer connected to the network or a data processing device using a communication protocol such as a TCP (Transmission Control Protocol) or an FTP (File Transfer Protocol). The network to which the communication I/F unit 112 is connected is a local area network (LAN), wired or wireless. Further, the network is not limited to the LAN, and may be connected to a Wide Area Network (WAN), the Public Switched Telephone Network (PSTN), the Internet, etc.

The facsimile unit 116 is connected to the Public Switched Telephone Network (PSTN), transmits facsimile data to the PSTN or receives facsimile data from the PSTN. The facsimile unit 116 stores the received facsimile data in the HDD 115, converts the facsimile data into print data that is printable by the image forming unit 140 and outputs the print data to the image forming unit 140. Thus, the image forming unit 140 forms an image of the facsimile data received from the facsimile unit 116 on a sheet. Further, the facsimile unit 116 converts the data stored in the HDD 115 into the facsimile data and transmits the facsimile data to the facsimile device connected to the PSTN.

The external storage device 118 is controlled by the CPU 111 and mounted with a CD-ROM (Compact Disk Read Only Memory) 118A or a semiconductor memory. While the CPU 111 executes the program stored in the ROM 113 in the present embodiment, by way of example, the CPU 111 may control the external storage device 118, read out the program to be executed by the CPU 111 from the CD-ROM 118A, store the read program in the RAM 114 and execute the program.

A recording medium for storing the program to be executed by the CPU 111 is not limited to the CD-ROM 118A but may be a flexible disk, a cassette tape, an optical disk (MO (Magnetic Optical Disc)/MD (Mini Disc)/DVD (Digital Versatile Disc)), an IC card, an optical card, or a semiconductor memory such as a mask ROM or an EPROM (Erasable Programmable ROM). Further, the CPU 111 may download a program from a computer connected to the network and store the program in the HDD 115, or the computer connected to the network may write the program in the HDD 115. Then, the program stored in the HDD 115 may be loaded into the RAM 114 to be executed by the CPU 111. The program referred to here includes not only a program directly executable by the CPU 111 but also a source program, a compressed program, an encrypted program and the like.

Figure 3:
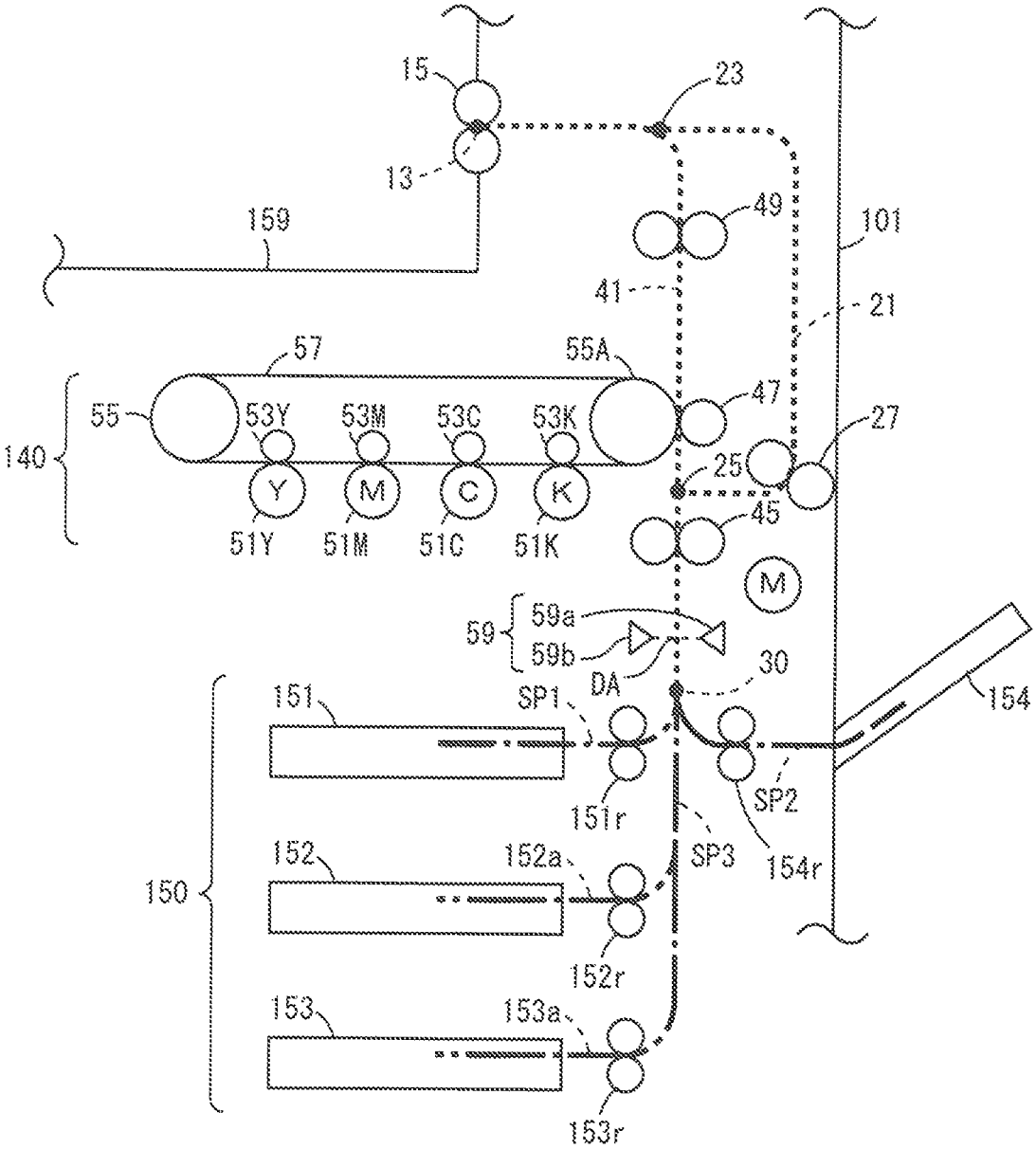
FIG. 3 is a schematic side view showing an inner configuration of part of an image forming unit and a paper feed unit included in the MFP in the first embodiment.

FIG. 3 is a schematic side view showing part of the inner configuration of the image forming unit and the paper feed unit included in the MFP in the first embodiment. Referring to FIG. 3, a main conveyance path 41 indicated by a thick dotted line is formed to basically extend in an up-and-down direction in the MFP 100. The main conveyance path 41 is the path for guiding the sheet that is conveyed from the paper feed unit 150 to the paper discharge tray 159 through the image forming unit 140. In the main conveyance path 41 of the present example, a lower end 30 opposite to an upper end 13 located at a position farther upward than the image forming unit 140 constitutes an inlet port for receiving sheets from the paper feed unit 150. Further, the upper end 13 of the main conveyance path 41 constitutes a discharge port for discharging sheets on which images have been formed to the paper discharge tray 159. A paper discharge roller 15 is provided at the upper end 13 of the main conveyance path 41. The main conveyance path 41 is connected to a plurality of sub-conveyance paths SP1, SP2, SP3 extending from the paper feed unit 150, described below, via the lower end 30. The direction in which sheets are conveyed is from the paper feed unit 150 towards the paper discharge tray 159.

The paper feed unit 150 includes the three paper feed cassettes 151, 152, 153 and the manual paper feed cassette 154. The three paper feed cassettes 151, 152, 153 are arranged in a stack in the direction from above to below in this order. The manual paper feed cassette 154 is provided at a sidewall 101 of the MFP 100 and is located at a position farther downward than the image forming unit 140. As indicated by a thick one-dot and dash line in FIG. 3, a sub-conveyance path SP1 is formed to extend from the paper feed cassette 151, which is the top cassette among the three paper feed cassettes 151, 152, 153, to the lower end 30 of the main conveyance path 41. Further, a sub-conveyance path SP2 is formed to extend from the manual paper feed cassette 154 to the lower end 30 of the main conveyance path 41. Further, two conveyance paths 152*a*, 153*a* are formed to respectively extend from the paper feed cassettes 152, 153, which are the middle and bottom cassettes among the three paper feed cassettes 151, 152, 153, to the lower end 30 of the main conveyance path 41. The portion from the lower end 30 of the main conveyance path 41 to the point where the main conveyance path 41 branches into the two conveyance paths 152*a*, 153*a* is a sub-conveyance path SP3, which is shared by the two conveyance paths 152*a*, 153*a*.

A paper feed roller 151*r* for feeding the sheets stored in the paper feed cassette 151 to the main conveyance path 41 is provided in the sub-conveyance path SP1. A paper feed roller 154*r* for feeding the sheets stored in the manual paper feed cassette 154 is provided in the sub-conveyance path SP2. A paper feed roller 152*r* for supplying the sheets stored in the paper feed cassette 152 to the main conveyance path 41 through the sub-conveyance path SP3 is provided in the conveyance path 152*a*. Further, a paper feed roller 153*r* for feeding the sheets stored in the paper feed cassette 153 to the main conveyance path 41 through the sub-conveyance path SP3 is provided in the conveyance path 153*a*.

When an image is to be formed on a sheet in the MFP 100, the cassette storing the sheet on which the image is to be formed is selected as a target cassette from among the three paper feed cassettes 151, 152, 153 and the manual paper feed cassette 154. The target cassette may be designated by a print job, or may be designated by the user. Further, the target cassette may be a default cassette. The paper feed roller corresponding to the target cassette among the three paper feed cassettes 151, 152, 153 and the manual paper feed cassette 154 is operated, whereby the sheet on which the image is to be formed is supplied to the main conveyance path 41 through one of the sub-conveyance paths SP1, SP2, SP3 from the target cassette.

The image forming unit 140 includes respective image forming units 51Y, 51M, 51C, 51K for respective yellow, magenta, cyan and black, an intermediate transfer belt 57, a driving roller 55, a roller 55A and a transfer roller 47. At least one of the image forming units 51Y, 51M, 51C, 51K is driven, so that an image is formed. When all of the image forming units 51Y, 51M, 51C, 51K are driven, a full-color image is formed. The print data pieces for yellow, magenta, cyan and black are respectively input in the image forming units 51Y, 51M, 51C, 51K. The only difference among the image forming units 51Y, 51M, 51C, 51K is the colors of toner handled by the image forming units 51Y, 51M, 51C, 51K. The image forming unit 51Y for forming images in yellow will be described here.

The image forming unit 51Y includes an exposure head in which print data for yellow is input, a photoreceptor drum (an image carrier), an electric charger, a developer and a transfer roller 53Y. The exposure head emits laser light according to the received print data (an electric signal). A polygon mirror included in the exposure head scans the emitted laser light one-dimensionally to expose the photoreceptor drum. The direction in which the laser light one-dimensionally scans the photoreceptor drum is a main scan direction. After being electrically charged by the electric charger, the photoreceptor drum is irradiated with the laser light emitted by the exposure head. Thus, an electrostatic latent image is formed on the photoreceptor drum. Subsequently, toner is applied onto the electrostatic latent image by the developer, and a toner image is formed. The toner image formed on the photoreceptor drum is transferred onto the intermediate transfer belt 57 by the transfer roller 53Y.

On the other hand, the intermediate transfer belt 57 is suspended by the driving roller 55 and the roller 55A not to loosen. When the driving roller 55 rotates in an anti-clockwise direction in the diagram, the intermediate transfer belt 57 rotates in the anti-clockwise direction at a predetermined speed. The roller 55A rotates in the anti-clockwise direction due to the rotation of the intermediate transfer belt 57.

Thus, the image forming units 51Y, 51M, 51C, 51K sequentially transfer toner images onto the intermediate transfer belt 57. Timing for transferring toner images onto the intermediate transfer belt 57 by the image forming units 51Y, 51M, 51C, 51K is adjusted by detection of a reference mark provided on the intermediate transfer belt 57. Thus, toner images in yellow, magenta, cyan and black are superimposed on the intermediate transfer belt 57. An image forming speed at which the respective image forming units 51Y, 51M, 51C, 51K form the toner images on the intermediate transfer belt 57 is indicated by the distance by which the intermediate transfer belt 57 moves in a sub-scanning direction per unit time. The driving roller 55 rotates such that the intermediate transfer belt 57 moves at the image forming speed.

In the above-mentioned main conveyance path 41, a timing roller 45, a transfer roller 47, a fuser roller 49 and the paper discharge roller 15 are arranged in this order at intervals from the lower end 30 to the upper end 13. The sheet that has been conveyed from the paper feed unit 150 to the main conveyance path 41 is sent to the timing roller 45. The path from one of the paper feed cassettes 151 to 153 and the manual paper feed cassette 154 to the timing roller 45 is referred to as a first conveyance path. Movable members arranged in the first conveyance path include paper feed rollers 151*r* to 154*r*. Further, part of the path that is located farther downstream than the timing roller 45 of the main conveyance path 41 is referred to as a second conveyance path. Movable members arranged in the second conveyance path include the timing roller 45, the transfer roller 47, the fuser roller 49 and the paper discharge roller 15.

The sheet is conveyed to the transfer roller 47 by the timing roller 45, toner is transferred by the transfer roller 47 and the toner is fused by the fuser roller 49. Thus, the image is formed. The timing roller 45 starts conveying the sheet such that the sheet arrives at the transfer roller 47 at the time point at which the toner image that has been formed on the intermediate transfer belt 57 arrives at the transfer roller 47. The sheet conveyed by the timing roller 45 is pressed against the intermediate transfer belt 57 by the transfer roller 47, and the transfer roller 47 is electrically charged. Thus, toner images in yellow, magenta, cyan and black that are formed on the intermediate transfer belt 57 in a superimposed manner are transferred to the sheet. The voltage applied to the transfer roller 47 is controlled by the CPU 111 such that an electric charge amount of the transfer roller 47 is a value suitable for the basis weight of the sheet. Because the intermediate transfer belt 57 moves at the image forming speed, the sheet is conveyed at the conveyance speed that is the same as the image forming speed.

The sheet onto which the toner image has been transferred is conveyed to the fuser roller 49 and heated by the fuser roller 49. Thus, the toner is fused and fixed to the sheet. Thereafter, the sheet on which the image has been formed is discharged onto the paper discharge tray 159 from the upper end 13 of the main conveyance path 41 by the paper discharge roller 15. The temperature of the fuser roller 49 is controlled by the CPU 111 to be the value suitable for the basis weight of the sheet.

An inverting path 21 extending from a first branch point 23 to a second branch point 25 in the main conveyance path 41 is formed. The inverting path 21 is part of the first conveyance path. The first branch point 23 is provided between the fuser roller 49 and the paper discharge roller 15 in the main conveyance path 41. The second branch point 25 is provided between the timing roller 45 and the transfer roller 47 in the main conveyance path 41. Using this inverting path 21, images can be formed on both of the front side and the back side of a sheet. Specifically, as described above, an image is formed on the front side of the sheet while the sheet is conveyed from one of the paper feed cassettes 151 to 153 and the manual paper feed cassette 154 to the paper discharge tray 159 along the main conveyance path 41. After the sheet having the front side on which the image has been formed passes through the fuser roller 49, the paper discharge roller 15 inverts the sheet while holding the sheet. Thus, the sheet having the front side on which the image has been formed travels in an opposite direction in the main conveyance path 41, and enters the inverting path 21 from the first branch point 23. The sheet that has entered the inverting path 21 re-enters the main conveyance path 41 from the second branch point 25. Thereafter, an image is formed on the back side of the sheet while the sheet is conveyed along the main conveyance path 41. An inversion timing roller 27 is arranged in the inverting path 21, and the time point at which the sheet arrives at the transfer roller 47 and the conveyance speed of the sheet along the main conveyance path 41 are adjusted by the inversion timing roller 27. A roller for conveying the sheet towards the inversion timing roller 27 may be provided between the paper discharge roller 15 and the inversion timing roller 27 in the inverting path 21.

In the MFP 100 in the present embodiment, a detection device 59 having a detection region DA is provided in the main conveyance path 41. The detection device 59 includes a light emitter 59*a* and a light receiver 59*a*, and is arranged between the lower end 30 of the main conveyance path 41 and the timing roller 45 such that the light emitter 59*a* and the light receiver 59*b* are opposite to each other with the main conveyance path 41 interposed therebetween. The light emitter 59*a* includes a light emitting element such as a light emitting diode, a driving circuit of the light emitting element and an optical system, and emits light along its optical axis. The light emitter 59*a* emits a predetermined amount of light to the detection region DA. The light receiver 59*b* includes a light receiving element such as a photodiode, and outputs the signal corresponding to the amount of light received by the light receiving element.

While the detection device 59 is described as an optical system in the present embodiment, the present invention is not limited to this embodiment. For example, the detection device 59 may be an ultrasonic sensor, a displacement sensor made of a roller, an electrostatic capacitance sensor or a camera, or a combination of these as long as being capable of determining the type of a sheet.

The detection device 59 is arranged to have the detection region DA in the main conveyance path 41. The region extending along the optical axis of the light emitter 59*a* in the main conveyance path 41 is the detection region DA. The detection region DA of the detection device 59 extends in the direction that intersects with the direction in which the sheet travels and the direction in which the sheet that travels through the main conveyance path 41. The detection region DA is the region between the light emitter 59*a* and the light receiver 59*b*. The direction in which the detection region DA extends is in parallel with the line that connects the center of the light emitter 59*a* to the center of the light receiver 59*b*. While the sheet travels through the main conveyance path 41 and crosses the detection region DA, part of the traveling sheet is irradiated with the light emitted from the light emitter 59*a*. At this time, part of the light emitted to the sheet is transmitted through the sheet, and the rest of the light emitted to the sheet is absorbed by the sheet or reflected from the sheet. The light receiver 59*b* receives the light that is transmitted through the sheet and outputs the signal corresponding to the amount of the received light to the CPU 111.

Figure 4:
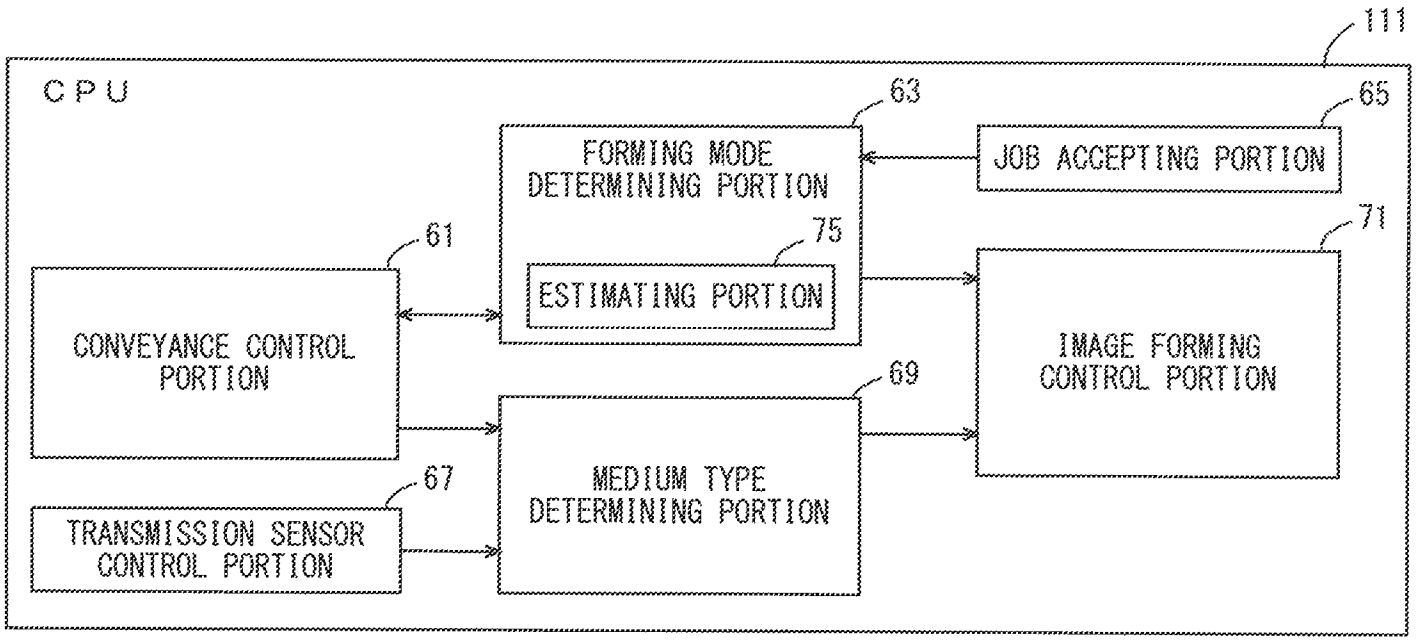
FIG. 4 is a block diagram showing one example of functions of a CPU included in the MFP in the first embodiment.

FIG. 4 is a block diagram showing one example of the functions of the CPU included the MFP in the first embodiment. The functions shown in FIG. 4 are the functions formed in the CPU 111 when the CPU 111 included in the MFP 100 executes an image forming program stored in the ROM 113, the HDD 115 or the CD-ROM 118A.

Here, the sheets, the medium type of which is the "plain paper," are stored in the paper feed cassette 151, the sheets, the medium type of which is the "thick paper," are stored in the paper feed cassette 152, the sheets, the medium type of which is the "thin paper," are stored in the paper feed cassette 153, and no sheet is stored in the manual paper feed cassette 154, by way of example.

An association table that respectively associates the medium types of the stored sheets to the paper feed cassettes 151 to 153 and the manual paper feed cassette 154 is stored in the HDD 115. However, a medium type may not be associated with a paper feed cassette in the association table in the case where the sheets stored in the paper feed cassette 151 have been replaced, for example. In the following description, although sheets of the plain paper are stored in the paper feed cassette 151, the paper feed cassette 151 is not associated with the medium type in the association table, by way of example.

Further, the conveyance speed, which is the same as the medium speed S1 that is defined as the image forming speed with respect to the medium type of the recording medium, is predetermined as the conveyance speed at which the recording medium is conveyed. In the case where the basis weight of a recording medium is large, or the case where the material of the recording medium is an OHP sheet such as polyethylene, when the recording medium is conveyed at the conveyance speed that is equal to or higher than the predetermined value, a plurality of movable members arranged in the first conveyance path and the second conveyance path may be damaged when colliding with the recording medium.

Referring to FIG. 4, the CPU 111 includes a conveyance control portion 61, a forming mode determining portion 63, a job accepting portion 65, a transmission sensor control portion 67, a medium type determining portion 69 for determining a medium type and an image forming control portion 71.

The job accepting portion 65 accepts an instruction, to execute a job, input by the user. In the case where the user operates the operation unit 163, the job accepting portion 65 accepts the instruction, to execute a print job or a copy job, that is input in the operation unit 163 by the user. Further, when the communication I/F unit 112 receives a print job from an external computer, the job accepting portion 65 accepts an instruction to execute the print job. Further, in the case where the MFP 100 is remotely operated by a portable device such as a smartphone, the communication I/F unit 112 communicates with the portable device. The job accepting portion 65 accepts the instruction, to execute a print job or a copy job, that is input by a remote operation received by the communication I/F unit 112 from the portable device. The job accepting portion 65 outputs the job specified by the accepted execution instruction to the forming mode determining portion 63. The job at least includes the data subject to image formation and a print condition. The print condition includes the number of copies, color/monochrome printing, simplex/duplex printing, and the information specifying one of the paper supply cassettes 151 to 153 and the manual paper feed cassette 154.

The forming mode determining portion 63 determines a forming mode based on the job accepted by the job accepting portion 65. The forming mode is one of a plurality of modes and is the mode in which the image forming unit 140 forms an image. In the present embodiment, the probable forming modes include first to fourth modes, by way of example. The first mode is the mode in which the MFP 100 forms an image at a medium speed S1 defined with respect to the medium type after the medium type of the sheet is determined by the medium type determining portion 69. Specifically, the first mode is the mode in which the MFP 100 conveys a sheet at a preparation speed S0 in a preparation period T1 and forms an image on the sheet at the medium speed S1 in an image forming period. The preparation period T1 is the time period from the time when the sheet is conveyed from one of the paper feed cassettes 151 to 153 and the manual paper feed cassette 154 until the time when the sheet arrives at the timing roller 45. In the case of full-color printing, the image forming period is the time period from the start of formation of an electrostatic latent image in a photoreceptor drum included in the image forming unit 51Y until discharging of the sheet onto the paper discharge tray 159 is completed. In the case of monochrome printing, the image forming period is the time period from the start of formation of an electrostatic latent image in a photoreceptor drum included in the image forming unit 51K until discharging of the recording media to the paper discharge tray 159 is completed. In the image forming period, a sheet is conveyed at the medium speed S1.

The preparation speed S0 is a predetermined image forming speed. In the present example, the preparation speed S0 is the slowest speed out of the medium speeds S1 that are defined as the image forming speeds with respect to the plurality of medium types. In the case where the medium type of sheets stored in the paper feed cassette 151 is not associated with any image forming speed by the association table, the conveyance control portion 61 sets the conveyance speed to the preparation speed S0. While the preparation speed S0 is set to the slowest speed out of the medium speeds S1 respectively defined as the image forming speeds with respect to the plurality of medium types, the present invention is not limited to this. The preparation speed S0 may be a predetermined speed. For example, the preparation speed S0 may be set to the highest speed possible to be set by the medium type determining portion 69 that determines a medium type of a recording medium, as described below. Further, in the case where the medium type of sheets stored in the paper feed cassette 151 is associated with the medium speed S1 by the association table, the conveyance control portion 61 may set the medium speed S1 that is defined as the image forming speed with respect to the medium type as the preparation speed S0.

The first mode is the mode that can be set as the forming mode in the case where a job defines the condition that one or more images are to be respectively formed on a plurality of sheets. In the case where a job defines the condition that a plurality of images are to be respectively formed on a plurality of sheets, the first mode defines the conveyance speed at which the first image is formed in the preparation period T1 as the preparation speed S0, and defines the image forming speed at which the first and subsequent images are respectively formed in the image forming period as the medium speed S1.

The second mode is the mode in which, after the medium type of the sheet is determined by the medium type determining portion 69, an image is formed not at the medium speed S1 that is defined with respect to the medium type but at the preparation speed S0. Specifically, the second mode is the mode in which a sheet is conveyed at the preparation speed S0 in the preparation period T1 and an image is formed on a sheet at the preparation speed S0 in the image forming period. The second mode is the mode that can be set as the forming mode in the case where a job defines the condition that one or more images are to be respectively formed on a plurality of sheets. In the case where a job defines the condition that a plurality of images are to be respectively formed on a plurality of sheets, the second mode defines the conveyance speed at which the first image is formed in the preparation period T1 as the preparation speed S0, and defines the image forming speed at which the first and subsequent images are respectively formed in the image forming period as the preparation speed S0.

The third mode and the fourth mode are the modes that can be set in the case where a job defines the condition that a plurality of images are to be formed on a plurality of sheets. The third mode defines the conveyance speed at which the first image is formed in the preparation period T1 as the preparation speed S0, defines the image forming speed at which the first image is formed in the image forming period as the preparation speed S0, and defines the image forming speed at which the second and subsequent images are formed in the image forming period as the medium speed S1. The fourth mode is the mode that can be set in the case where a print condition defined by a job includes a time interval condition. The time interval condition is the condition that it is necessary to provide a wait time interval Tw between formations of two consecutive images among a plurality of images. The time interval conditions include the condition that monochrome-image formation is to switched to the color-image formation, the condition that the color-image formation is switched to the monochrome-image formation, the condition that the duplex printing is switched to the simplex printing, or the condition that the simplex printing is switched to the duplex printing, for example. Further, the time interval condition includes the condition that the post-process is performed on a plurality of sheets on which images have been formed. The post-process includes a sort-process of sorting a plurality of sheets, a punching process of punching a paper bundle and a stapling process of stapling a paper bundle.

In the fourth mode, in the case where the wait time interval Tw defined by the time interval condition is set between the formation of the N-th (N is an integer that is equal to or larger than 1) and the formation of the (N+1)-th image, the conveyance speed at which the first image is formed in the preparation period T1 is the preparation speed S0, the image forming speed at which the first to the N-th images are formed in the image forming period is the preparation speed S0, and the image forming speed at which the (N+1)-th and subsequent images are respectively formed in the image forming period is the medium speed S1.

In the case where the number, that is defined by a job, of images to be formed is equal to or larger than a predetermined number TH, the forming mode determining portion 63 determines the first mode as the forming mode. It is known in advance that, in the case where the number, that is defined by a job of images to be formed is equal to or larger than the predetermine number TH, when the job accepted by the job accepting portion 65 is executed with the first mode set as the forming mode, the job execution time length from the start to the end of execution of the job is the shortest. The predetermined value TH may be obtained by experiments or simulation, and may be predetermined. Further, different values of the predetermined number TH may be defined with respect to a plurality of medium types.

In the case where the number, that is defined by a job, of images to be formed is smaller than the predetermined number TH, the forming mode determining portion 63 determines one of the first to fourth modes as the forming mode. The forming mode determining portion 63 includes an estimating portion 75. The estimating portion 75 estimates a job execution time length from the start to the end of the execution of a job accepted by the job accepting portion 65. The estimating portion 75 estimates the respective job execution time lengths in the case where the job is executed in the respective first to fourth modes that are the probable forming modes. Further, in the stage where the forming mode determining portion 63 determines the forming mode, the medium type of the sheet is not determined. Because the number of medium types is two or more, the estimating portion 75 estimates the respective job execution time lengths corresponding to the respective first to fourth modes with respect to the plurality of respective medium types. Hereinafter, the job execution time length corresponding to the first mode is referred to as a first execution time length ST1, the job execution time length corresponding to the second mode is referred to as a second execution time length ST2, the job execution time length corresponding to the third mode is referred to as a third execution time length ST3, and the job execution time length corresponding to the fourth mode is referred to as a fourth execution time length ST4. The estimating portion 75 estimates the respective first to fourth execution time lengths ST1 to ST4 with respect to the plurality of respective medium types.

The forming mode determining portion 63 determines one of the plurality of modes based on the first to the fourth execution time lengths ST1 to ST4 with respect to each of the plurality of medium types. Specifically, the forming mode determining portion 63 determines the mode corresponding to the shortest job execution time length among the first to the fourth execution time lengths ST1 to ST4 as the forming mode with respect to the medium type. Then, the forming mode determining portion 63 determines which mode among the first to fourth modes has been selected as the forming mode with respect to the largest number of medium types. The forming mode determining portion 63 outputs the determined forming mode to the conveyance control portion 61 and the image forming control portion 71. In the case where the number of modes that has been selected as the forming mode with respect to the largest number of medium types is two or more, the forming mode determining portion 63 determines any mode from among the plurality modes that have been selected as the forming mode with respect to the largest number of medium types as the forming mode.

Figure 5:
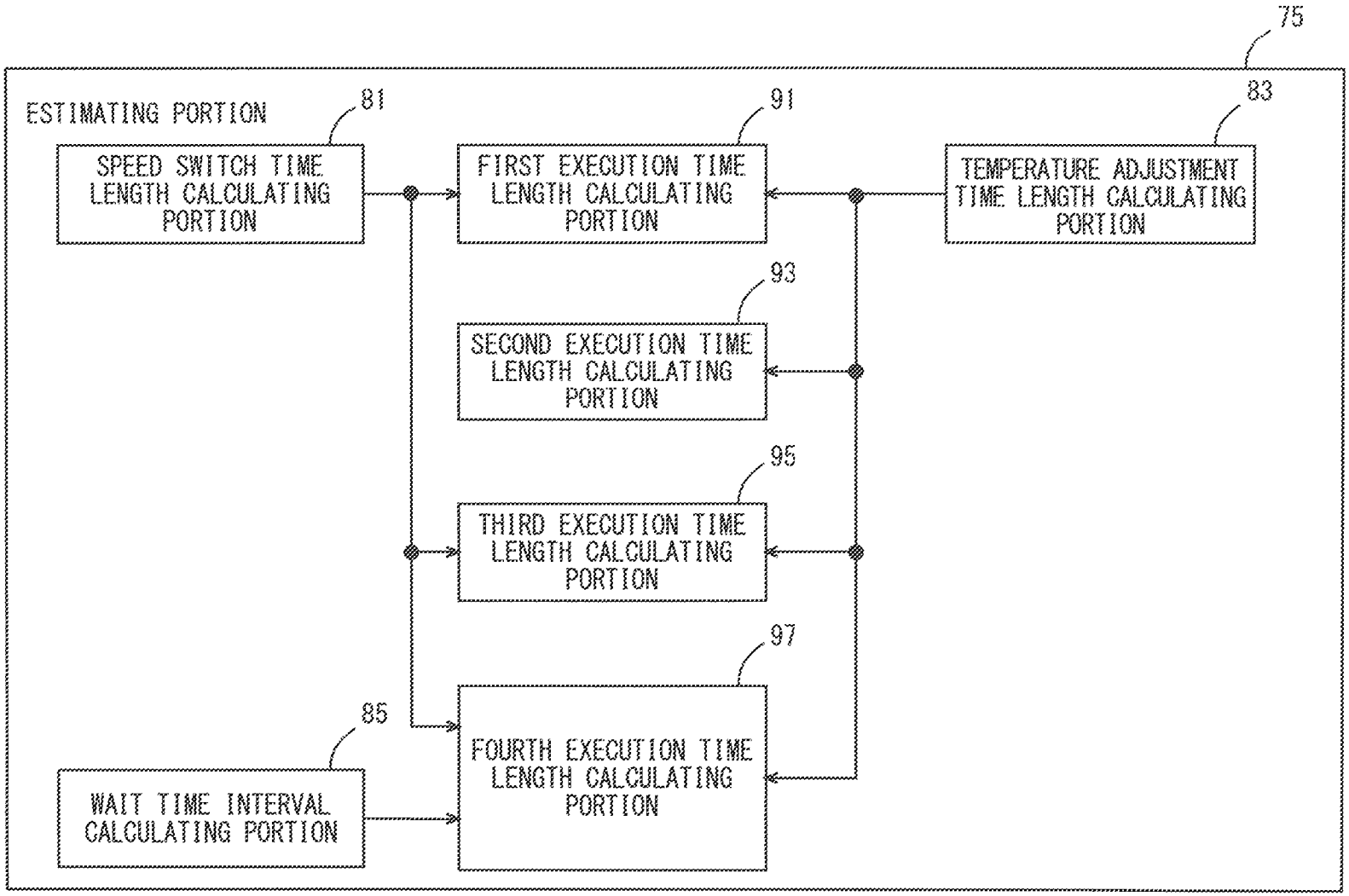
FIG. 5 is a block diagram showing one example of detailed functions of an estimating portion.

FIG. 5 is a block diagram showing one example of the detailed functions of the estimating portion. Referring to FIG. 5, the estimating portion 75 includes a speed switch time length calculating portion 81, a temperature adjustment time length calculating portion 83, a wait time interval calculating portion 85 and first to fourth execution time length calculating portions 91, 93, 95, 97.

The speed switch time length calculating portion 81 calculates a speed switch time length Tc required for the image forming unit 140 to change the image forming speed from the preparation speed S0 to the medium speed S1. The speed switch time length Tc includes the time length required for adjustment of the number of rotations of a polygon meter, the time length required for adjustment of the number of rotations of a photoreceptor drums respectively included in the image forming units 51Y, 51M, 51C, 51K, etc. The number of medium types is two or more, and the medium speed S1 is defined by the medium type. Thus, the speed switch time length calculating portion 81 calculates a speed switch time length Tc with respect to each medium type. For example, the speed switch time length calculating portion 81 calculates the speed switch time length Tc using a conversion formula defining the relationship between the preparation speed S0, the medium speed S1 and the speed switch time length Tc. The table defining the speed switch time length Tc with respect to each medium type may be predetermined.

The temperature adjustment time length calculating portion 83 calculates a temperature adjustment time length Tf required for the temperature of the fuser roller 49 to change from a temporary temperature to the temperature suitable for the medium type. The temperature of the fuser roller 49 is defined by the medium type. Before the medium type is determined, the temperature of the fuser roller 49 is adjusted to the temporary temperature. After the medium type is determined, the temperature of the fuser roller 49 is adjusted to the temperature suitable for the medium type. The temporary temperature is predetermined. The larger the basis weight defined by the medium type is, the higher the temperature suitable for the medium type of the fuser roller 49 is. Therefore, the temporary temperature is preferably the temperature of the fuser roller 49 that is defined with respect to the medium type having the smallest basis weight. In response to the determination of the medium type by the medium type determining portion 69, the temperature adjustment time length calculator 83 calculates the time length required for the temperature of the fuser roller 49 to change from the temporary temperature to the temperature suitable for the medium type as the temperature adjustment time length Tf. Different temperature adjustment time lengths Tf are calculated with respect to the different medium types. Since the number of medium types is two or more, the temperature adjustment time length calculating portion 83 calculates the respective temperature adjustment time lengths Tf with respect to the respective medium types. For example, the temperature adjustment time length calculating portion 83 calculates the temperature adjustment time lengths Tf using the conversion formula in consideration of variation factors such as an outside air temperature. The table defining the respective temperature adjustment time lengths Tf with respect to the respective medium types may be predetermined.

In the case where the print condition that is defined by the job accepted by the job accepting portion 65 defines the time interval condition, the wait time interval calculating portion 85 calculates the wait time interval Tw defined by the time interval condition. For example, in the case where the time interval condition is that the simplex printing switches to the duplex printing, because the sheet on which an image is formed on the front side thereof is conveyed through the inverting path 21, it requires a longer length of time to perform duplex printing than the simplex printing by the time length during which the sheet is conveyed through the inverting path 21. Therefore, the wait time interval calculating portion 85 calculates the wait time interval Tw based on the length of the inverting path 21 and the preparation speed S0, which is the conveyance speed.

The first execution time length calculating portion 91 calculates the first execution time length ST1 with respect to each of the plurality of medium types. The first execution time length calculating portion 91 calculates the first execution time length ST1 using the speed switch time length Tc and the temperature adjustment time length Tf. The speed switch time length Tc and the temperature adjustment time length Tf are transition time lengths required for the image forming unit 140 to change from being capable of forming images at the preparation speed S0 to be capable of forming images at the medium speed S1. Further, in the case where the print condition includes the time interval condition, the first execution time length calculating portion 91 calculates the first execution time length ST1 further using the wait time interval Tw.

The second execution time length calculating portion 93 calculates the second execution time length ST2 with respect to each of the plurality of medium types. The second execution time length calculating portion 93 calculates the second execution time length ST2 using the temperature adjustment time length Tf. Further, in the case where the print condition includes the time interval condition, the second execution time length calculating portion 93 calculates the second execution time length ST2 further using the wait time interval Tw.

The third execution time length calculating portion 95 calculates the third execution time length ST3 with respect to each of the plurality of medium types. The third execution time length calculating portion 95 calculates the third execution time length ST3 using the temperature adjustment time length Tf and the speed switch time length Tc. The third execution time length calculating portion 95 calculates the third execution time length ST3 using the longer time length between the time interval, from the end of the formation of the first image to the start of the formation of the second and subsequent images, and the speed switch time length Tc. In the case where the print condition includes the time interval condition, the third execution time length calculating portion 95 calculates the third execution time length ST3 further using the wait time interval Tw.

The fourth execution time length calculating portion 97 calculates the fourth execution time length ST4 with respect to each of the plurality of medium types. The fourth execution time length calculating portion 97 calculates the fourth execution time length ST4 using the temperature adjustment time length Tf, the speed switch time length Tc and the wait time interval Tw. The fourth execution time length calculating portion 97 calculates the fourth execution time length ST4 using the longer time length between the wait time interval Tw and the speed switch time length Tc.

Returning to FIG. 4, the conveyance control portion 61 controls the paper feed unit 150 and allows the paper feed unit 150 to convey the sheets stored in one of the paper feed cassettes 151 to 153 and the manual paper feed cassette 154 according to the forming mode received from the forming mode determining portion 63. The conveyance control portion 61 controls the speed at which sheets are conveyed and time points at which sheets are conveyed. The conveyance control portion 61 controls the paper feed unit 150 and allows the paper feed unit 150 to convey sheets at a plurality of different conveyance speeds. Specifically, the conveyance control portion 61 rotates the motor M by the number of rotations corresponding to the conveyance speed by controlling a duty ratio of the voltage applied to the motor M.

The conveyance control portion 61 determines the cassette defined by the print condition from among the paper feed cassettes 151 to 153 and the manual paper feed cassette 154 as a target cassette. The paper feed cassette 151 is determined as the target cassette, by way of example. The conveyance control portion 61 conveys the sheet at the top of a stack of sheets stored in the paper feed cassette 151, which is the target cassette, to the timing roller 45 at the preparation speed S0. After the sheet arrives at the timing roller 45, the conveyance control portion 61 conveys the sheet at the conveyance speed that is the same as the image forming speed defined by the forming mode determined by the forming mode determining portion 63.

One portion of the sheet passes through a detection region DA in the preparation period T1 from the start of conveyance of the first sheet by the conveyance control portion 61 until the arrival of the sheet at the timing roller 45. The transmission sensor control portion 67 controls the detection device 59, and determines the transmissivity TR of the light through the sheet when the sheet that has been fed from the paper feed unit 150 to the main conveyance path 41 moves through the detection region DA of the detection device 59. Specifically, the transmission sensor control portion 67 acquires an output signal from the light receiver 59*b* of the detection device 59, calculates a light reception amount based on the output signal, and calculates the ratio of the light amount of the light received by the light receiver 59*b* to the light amount of the light emitted by the light emitter 59*a* as the transmissivity TR. The transmission sensor control portion 67 outputs the calculated transmissivity TR to the medium type determining portion 69.

The medium type determining portion 69 receives the transmissivity TR from the transmission sensor control portion 67. The medium type determining portion 69 determines the medium type of the sheet based on the transmissivity TR. The medium type determining portion 69 determines the basis weight corresponding to the transmissivity TR using the medium type conversion information. The medium type conversion information is the information defining the correspondence between the basis weight and the transmissivity. The medium type conversion information is produced by experiments and the like in advance and stored in the HDD 115. Further, the medium type determining portion 69 determines the medium type corresponding to the basis weight determined based on the transmissivity TR. It is known that the basis weights of the sheets of the plurality of medium types respectively fall within predetermined ranges. Thus, the correspondence table indicating the correspondence between the medium types and the ranges of the basis weights of the sheets of the medium types may be stored in the HDD 115 in advance. The medium type determining portion 69 outputs the medium type of a sheet to the image forming control portion 71.

The image forming control portion 71 controls the image forming unit 140, determines an image forming condition based on the medium information that is received from the medium type determining portion 69 and the image forming speed defined by the forming mode determined by the forming mode determining portion 63, and allows the formation of the image of the print data according to the image forming condition. Specifically, the image forming control portion 71 controls the image forming unit 140 such that the transfer roller 47 is electrically charged to the potential suitable for the transfer of a toner image that is formed on the intermediate transfer belt 57 onto the sheet, which is the subject medium on which an image is to be formed. Further, the image forming control portion 71 adjusts the temperature of the fuser roller 49 based on the medium information such that toner is fused at the temperature suitable for the sheet of the subject medium on which an image is to be formed. Specifically, the image forming control portion 71 determines the potential of the transfer roller 47 and the temperature of the fuser roller 49 based on the medium type and the image forming speed, controls the image forming unit 140 such that the transfer roller 47 is electrically charged to the determined potential, and controls the image forming unit 140 such that the temperature of the fuser roller 49 is the determined temperature.

Next, a specific example will be described regarding the method of calculating the first to fourth execution time lengths ST1 to ST4 respectively corresponding to the first to fourth modes. Here, the first to fourth execution time lengths ST1 to ST4, calculated in the case where the paper feed cassette 151 is set as the target cassette and an image is to be formed on a sheet stored in the paper feed cassette 151, will be described.

Figure 6:
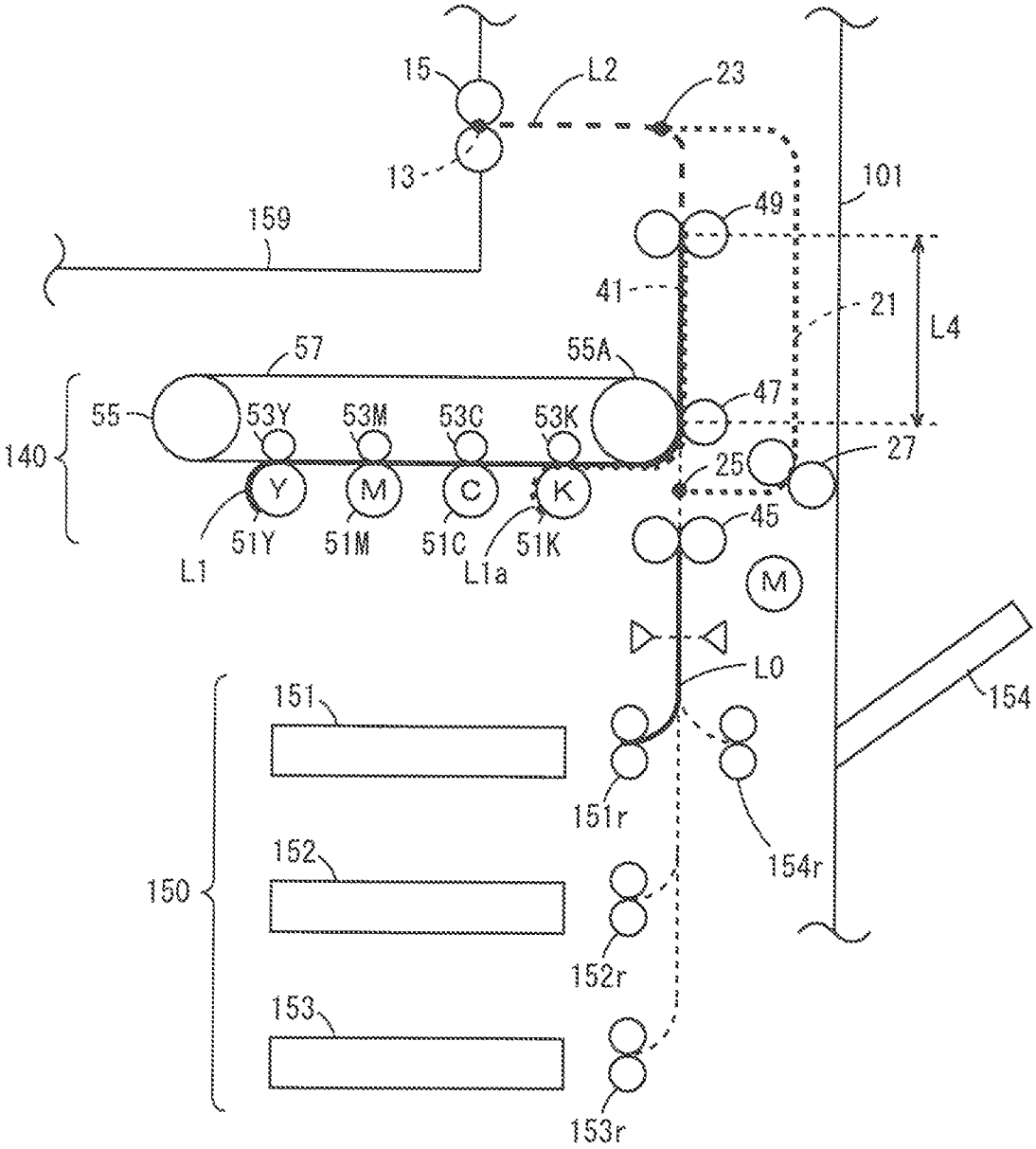
FIG. 6 is a diagram for explaining various distances in a conveyance path.

FIG. 6 is a diagram for explaining various lengths of the conveyance paths. Referring to FIG. 6, the distance from the paper feed roller 151*r* to the timing roller 45 is a preparation distance L0, the distance from the position irradiated with laser light of the photoreceptor drum included in the image forming unit 51Y to the fuser roller 49 in the case of formation of a full-color image is an image formation distance L1, the distance from the transfer roller 47 to the paper discharge roller 15 is a distance L2, and the distance from the transfer roller 47 to the fuser roller 49 is a distance L4. Further, in the case of formation of a monochrome image, the image formation distance L1 is the distance L1*a* from the position irradiated with the laser light of the photoreceptor drum included in the image forming unit 51K to the fuser roller 49. The distance by which the sheet stored in the paper feed cassette 151 is conveyed to the timing roller 45 is the preparation distance L0 from the paper feed roller 151*r* to the timing roller 45.

Figure 7:
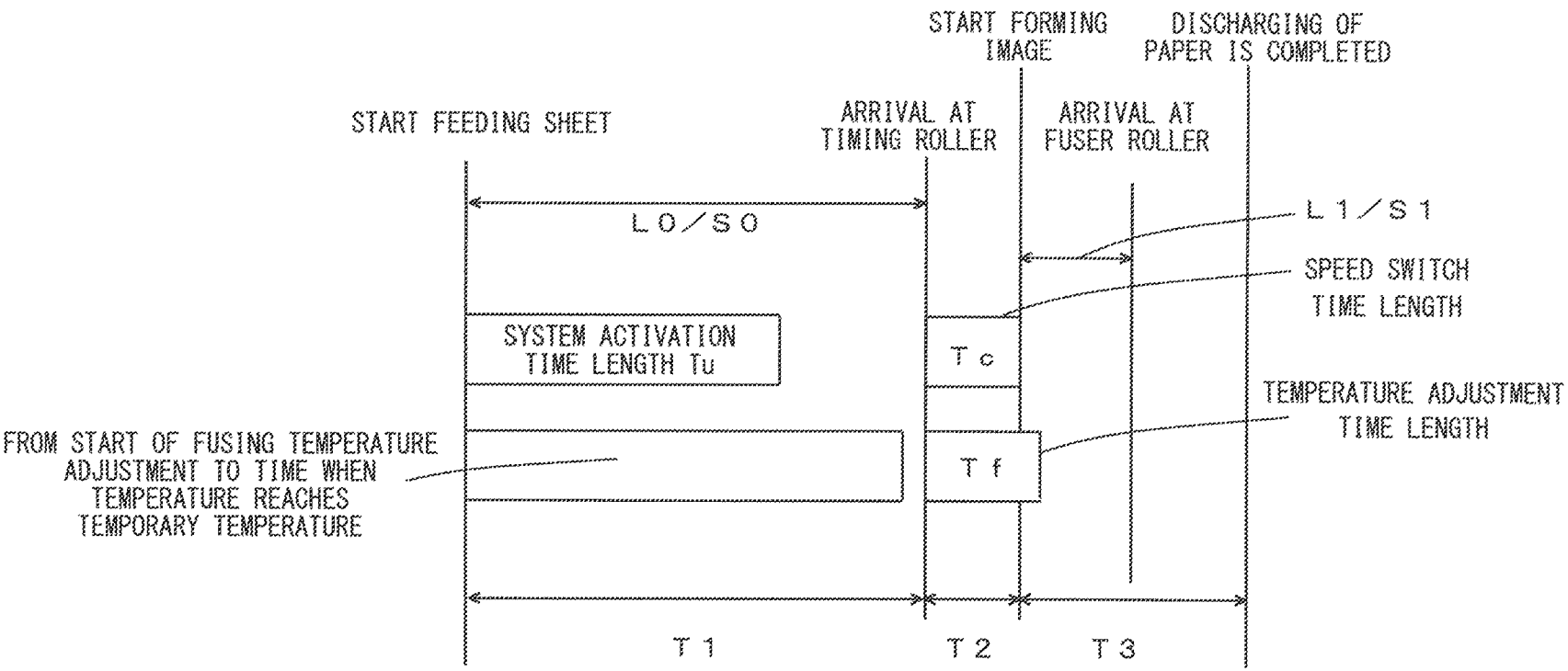
FIG. 7 is a diagram for explaining a method of calculating a first execution time length in a first mode.

FIG. 7 is a diagram for explaining the method of calculating the first execution time length in the first mode. Referring to FIG. 7, when the conveyance of a sheet stored in the paper feed cassette 151 starts, the image forming unit 140 is adjusted to be capable of forming an image at the preparation speed S0. The time length required for the image forming unit 140 to be in the state of being capable of forming an image at the preparation speed S0 is referred to as a system activation time length Tu. The system activation time length Tu includes an activation time length of the polygon motor, activation time lengths of the image forming units 51Y, 51M, 51C, 51K and the like. Further, when the conveyance of a sheet stored in the paper feed cassette 151 starts, the temperature of the fuser roller 49 is adjusted to the temporary temperature that is temporarily set at the start of the conveyance of the sheet.

The preparation time length T1 from the start of conveyance of the sheet stored in the paper feed cassette 151 until the arrival of the front end of the sheet at the timing roller 45 can be calculated by the preparation period T1=L0/S0 since the sheet is conveyed at the preparation speed S0.

Then, at the time point at which the medium type of the sheet is determined in the preparation period T1, the temperature of the fuser roller 49 is adjusted to the temperature suitable for the medium type. Here, for the purposes of description, the medium type is defined at the time point at which the front end of the sheet arrives at the timing roller 45. The time length required for the temperature of the fuser roller 49 to be adjusted from the temporary temperature to the temperature suitable for the medium type is referred to as the temperature adjustment time length Tf. Different temperature adjustment time lengths Tf are calculated with respect to different medium types. Thus, it is necessary to prevent the sheet from arriving at the fuser roller 49 until the temperature of the fuser roller 49 is the temperature suitable for the medium type. Further, the medium speed S1 is determined at the time point at which the medium type is determined. When the medium speed S1 is determined, the image forming speed is switched from the preparation speed S0 to the medium speed S1. Thus, the image formation cannot be started until the speed switch time length Tc elapses from the time point of determination of the medium type.

Therefore, the time length T2 from arrival of the front end of a sheet at the timing roller 45 until the time when the image forming unit 140 is capable of forming an image is the larger value between the time length obtained when L1/S1 is subtracted from the temperature adjustment time length Tf and the speed switch time length Tc, and is expressed by the following formula (1). In FIG. 7, the speed switch time length Tc is longer than the time length obtained when L1/S1 is subtracted from the temperature adjustment time length Tf, by way of example. In this case, after the speed switch time length Tc elapses from the time of determination of the medium type of the sheet, the image formation starts. Then, the time point at which the timing roller 45 starts conveyance of the sheet is adjusted such that the sheet arrives at the transfer roller 47 at the time point at which a toner image that is formed on the intermediate transfer belt 57 after the start of the image formation arrives at the transfer roller 47. Further, because the temperature of the fuser roller 49 has reached the temperature suitable for the medium type before the sheet arrives at the fuser roller 49, toner can be fused at the temperature suitable for the sheet.

In the case where a full-color image is formed, the image forming unit 140 becomes capable of starting to form an image when the photoreceptor drum included in the image forming unit 51Y is irradiated with laser light. In the case where a monochrome image is to be formed, the image forming unit 140 becomes capable of starting to form an image when the photoreceptor drum included in the image forming unit 51K is irradiated with laser light. Here, a full-color image is formed, by way of example.

Letting the length of the sheet in the conveyance direction be L3, the time length T3 from the start of the image formation until the time point at which the rear end of the sheet passes through the paper discharge roller 15 is expressed by the formula (2). Further, in the case where the job defines formation of a plurality of images, the image forming speed of the second and subsequent images is the medium speed S1. Letting the distance between the sheets be the distance BL, a sheet pitch Tp1 that is the time length from the start of the image formation of one sheet until the start of the image formation of the next sheet is expressed by the following formula (3). Therefore, in the case where N (N is an integer that is equal to or larger than 1) images are to be formed on N sheets, the first execution time length ST1 is expressed by the following formula (4).

$$T2=\mathrm{MAX}(Tf-L1/S1,Tc) \quad (1)$$

However, MAX (A, B) indicates the largest value between A and B.

$$T3=(L1+L2+L3)/S1 \quad (2)$$

$$Tp1=(L3+BL)/S1 \quad (3)$$

$$ST1=T1+T2+T3+Tp1*(N-1) \quad (4)$$

However, N is an integer that is equal to or larger than 1.

Figure 8:
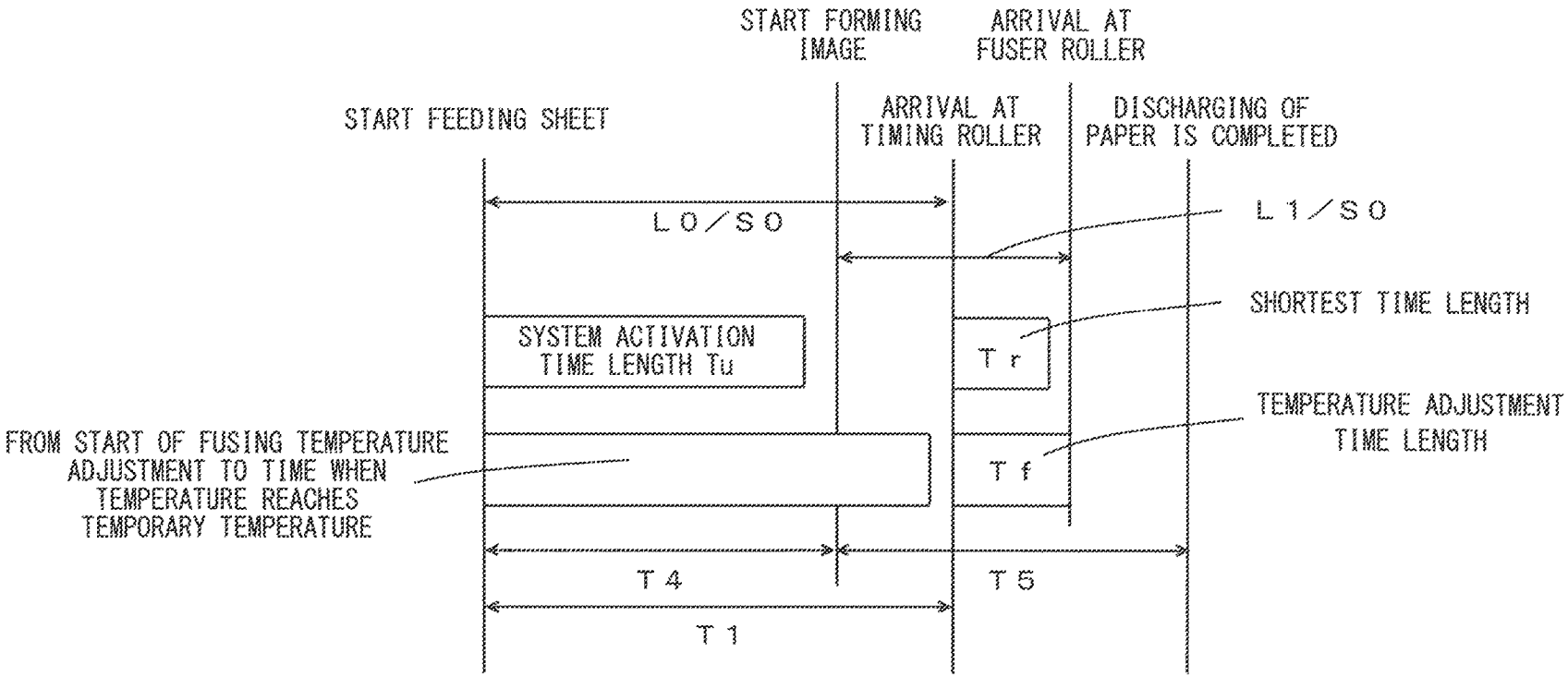
FIG. 8 is a diagram for explaining a method of calculating a second execution time length in a second mode.

FIG. 8 is a diagram for explaining the method of calculating the second execution time length in the second mode. Referring to FIG. 8, the preparation period T1 from the start of the conveyance of a sheet stored in the paper feed cassette 151 until the arrival of the front end of the sheet at the timing roller 45 is the same as the preparation T1 in the case of the first mode shown in FIG. 7.

Here, the shortest time length from the arrival of the front end of the sheet at the timing roller 45 until the arrival of the front end of the sheet at the fuser roller 49 is a shortest time length Tr. The shortest time length Tr includes the time length during which the sheet is bent and arranged in a certain direction in addition to the time length required for the sheet to be conveyed.

In the second mode, the time length T4 from the start of the conveyance of the sheet until the start of the image formation is determined such that the front end of the sheet arrives at the fuser roller 49 after the temperature of the fuser roller 49 is the temperature suitable for the medium type and the conveyance speed of the sheet. Specifically, the time length T4 is expressed by the formula (5). The time length T4 is the largest value between the time length obtained when L1/S0 is subtracted from the value, which is obtained when the temperature adjustment time length Tf is added to the preparation period T1, the time length obtained when L1/S0 is subtracted from the value, which is obtained when the shortest time length Tr is added to the preparation period T1, and the system activation time length Tu. In FIG. 8, the value obtained when L1/S0 is subtracted from the value, which is obtained when the temperature adjustment time length Tf is added to the preparation period T1 in the formula (5) is the largest, thereby being the time length T4, by way of example. The time length T4 is determined according to the formula (5), whereby it is possible to make the front end of the sheet arrive at the fuser roller 49 after the temperature of the fuser roller 49 is the temperature suitable for the medium type. Therefore, a toner image can be fused on the sheet at the temperature suitable for the medium type of the sheet.

Letting the length of the sheet in the conveyance direction be L3, an image formation time length T5 from the start of the image formation until the time when the rear end of the sheet passes through the paper discharge roller 15 is expressed by the formula (6). Further, in the case where the job defines formation of a plurality of images, the sheets on which second and subsequent images are to be formed are conveyed at the medium speed S1. Letting the distance between the sheets be a distance BL, a sheet pitch Tp2 from the start of the image formation on one sheet until the start of the image formation on the next sheet is expressed by the following formula (7). Thus, in the case where N (N is an integer equal to or larger than 1) images are to be formed on N sheets, the second execution time length ST2 is expressed by the following formula (8).

$$T4=\mathrm{MAX}(T1+Tf-L1/S0, T1+Tr-L1/S0, Tu) \quad (5)$$

$$T5=(L1+L2+L3)/S0 \quad (6)$$

$$Tp2=(L3+BL)/S0 \quad (7)$$

$$ST2=T4+T5+Tp2*(N-1) \quad (8)$$

N is an integer that is equal to or larger than 1.

Figure 9:
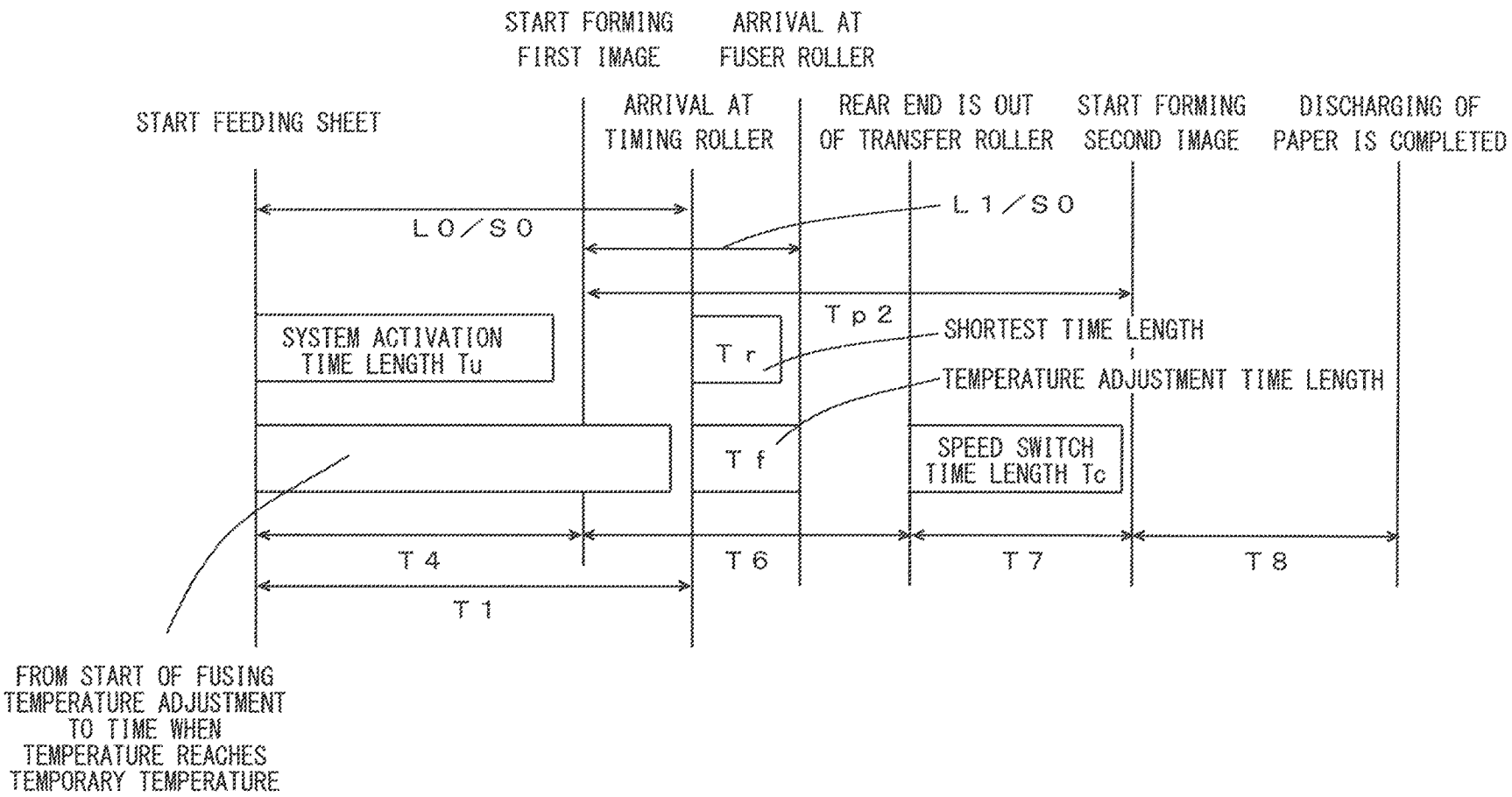
FIG. 9 is a diagram for explaining a method of calculating a third execution time length in a third mode.

FIG. 9 is a diagram for explaining the method of calculating the third execution time length in the third mode. The method of calculating the third execution time length in the third mode is the same as the method of calculating the second execution time length in the second mode shown in FIG. 8 until the formation of the first image is completed. In the third mode, the time length T4 from the start of conveyance of the sheet on which a first image is to be formed until the start of the image formation is calculated using the above-mentioned formula (5) such that the front end of the sheet on which the first image is to be formed arrives at the fuser roller 49 after the medium type of the sheet on which the first image is to be formed is determined and the temperature of the fuser roller 49 is the temperature suitable for the medium type. Letting the length of the sheet in the conveyance direction be L3, a time length T6 from the start of the image formation until the time when the rear end of the sheet on which the first image is to be formed passes through the transfer roller 47 is expressed by the formula (9).

After the rear end of the sheet on which the first image is to be formed passes through the transfer roller 47, the image forming speed is switched from the preparation speed S0 to the medium speed S1. Therefore, the speed switch time length Tc is required after the rear end of the sheet on which the first image is to be formed passes through the transfer roller 47. Further, a sheet pitch Tp2 is required as the period from the start of the image formation on the sheet on which the first image is to be formed until the start of the image formation on the sheet on which the second image is to be formed. Therefore, the time length Tp2-T6 is at least required as the time length from the time when the rear end of the sheet on which the first image is to be formed passes through the transfer roller 47 until the start of the image formation on the sheet on which a second image is to be formed. Therefore, a time length T7 from the time when the rear end of the sheet on which the first image is to be formed passes through the transfer roller 47 until the start of the image formation on the sheet on which the second image is to be formed is the longest time length between the value obtained when the time length T6 is subtracted from the sheet pitch Tp2 and the speed switch time length Tc, and is expressed by the following formula (10). In FIG. 9, the value obtained when the time length T6 is subtracted from the sheet pitch Tp2 is larger than the speed switch time length Tc, by way of example. In this case, the value obtained when the time length T6 is subtracted from the sheet pitch Tp2 is also required when the conveyance speed is not switched. Thus, it is possible to switch the conveyance speed from the preparation speed S0 to the medium speed S1 by utilizing the time length.

Further, a time length T8 from the start of the image formation on the sheet on which the second image is to be formed until discharging of the sheet is expressed by the following formula (11). Therefore, in the case where N images are to be formed on N sheets in the third mode, the third execution time length ST3 is expressed by the next formula (12).

$$T6=(L1+L3-L4)/S0 \quad (9)$$

$$T7=\mathrm{MAX}(Tp2-T6, Tc) \quad (10)$$

$$T8=(L1+L2+L3)/S1 \quad (11)$$

$$ST3=T4+T6+T7+T8+Tp1*(N-2) \quad (12)$$

However, Tp1=(L3+BL)/S1, and N is an integer that is equal to or larger than 2.

Figure 10:
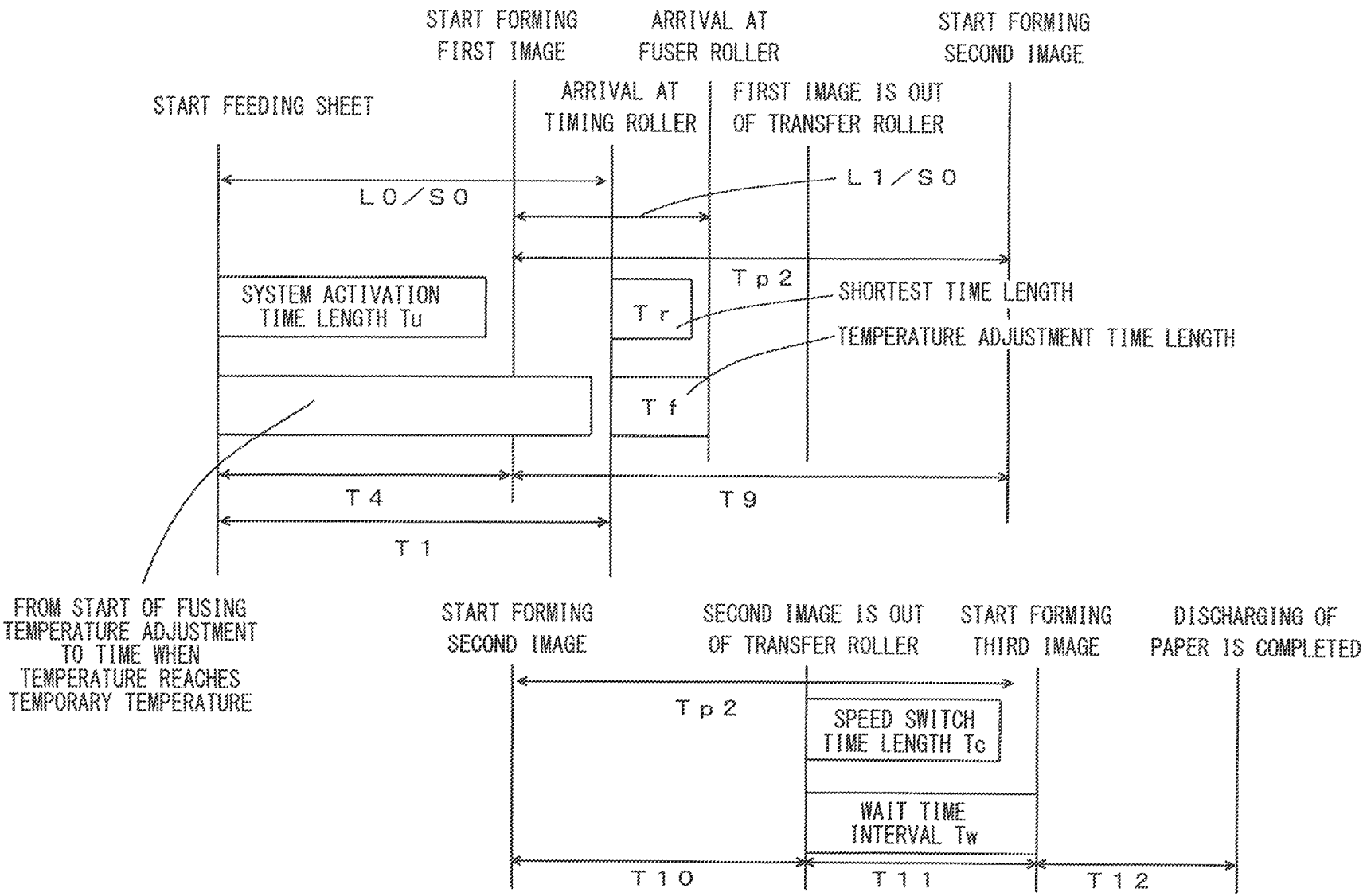
FIG. 10 is a diagram for explaining a method of calculating a fourth execution time length in a fourth mode.

FIG. 10 is a diagram for explaining the method of calculating the fourth execution time length in the fourth mode. Referring to FIG. 10, the method of calculating the fourth execution time length in the fourth mode is the same as the method of calculating the third execution time length in the third mode shown in FIG. 9 until the start of the image formation on the sheet on which the second image is to be formed. Therefore, in the third mode, the time length T4 from the start of the conveyance of the sheet on which the first image is to be formed until the start of the image formation is determined such that the front end of the sheet on which the first image is to be formed arrives at the fuser roller 49 after the temperature of the fuser roller 49 is the temperature suitable for the medium type. Specifically, the time length T4 is calculated by the calculation formula shown in the above-mentioned formula (5).

In the case where the image forming speed is the preparation speed S0, the time length from the start of the formation of the first image until the start of the formation of the second image is the sheet pitch Tp2. In the case where the time interval condition is set between formation of the second image and formation of a third image in the print condition, the wait time interval Tw is required between the time when the rear end of the sheet on which the second image is to be formed passes through the transfer roller 47 and the start of the formation of the third image. The lengths of the wait time intervals Tw differ depending on the time interval conditions. Here, the time interval condition that the simplex printing is set for a first image, and the duplex printing is set for second and third images is defined, by way of example. In this case, the wait time interval Tw is the time length required for the sheet on which the second image is to be formed to pass through the inverting path 21 and arrive at the inversion timing roller 27.

In the fourth mode, after the rear end of the sheet on which the second image is to be formed passes through the transfer roller 47, the image forming speed switches from the preparation speed S0 to the medium speed S1. A time length T10 from the start of the image formation on the sheet on which the second image is to be formed until the time when the rear end of the sheet passes through the transfer roller 47 is expressed by the following formula (13). Therefore, as a time length T11 from the start of the image formation on the front side of the sheet on which the second image is to be formed until the start of the image formation on the back side of the sheet on which the third image is to be formed, the time length Tp-T10 is at least required. Further, a speed switch time length Tc is required after the rear end of the sheet on which the second image is to be formed passes through the transfer roller 47. Further, as the time length T11 from the start of the image formation on the front side of the sheet on which the second image is to be formed until the start of the image formation on the back side of the sheet on which the third image is to be formed, the wait time interval Tw is required. Thus, as the time length T11 from the time when the rear end of the sheet on which the second image is to be formed passes through the transfer roller 47 until the start of the image formation on the sheet on which the third image is to be formed, the longer time length between the speed switch time length Tc and the wait time interval Tw is required. Therefore, the time length T11 from the time when the rear end of the sheet on which the second image is to be formed passes through the transfer roller 47 until the start of the image formation on the sheet on which the third image is to be formed is the longest time length between the time length Tp2-T10, the speed switch time length Tc and the wait time interval Tw, and is expressed by the following formula (14). In FIG. 10, the wait time interval Tw is the longest time length, by way of example. In this case, the wait time interval Tw is required even in the case where the conveyance speed is not switched, so that it is possible to switch the conveyance speed by utilizing the time length.

Further, a time length T12 from the start of image formation on the sheet on which the third image is to be formed until discharging of the sheet is expressed by the following formula (15). Therefore, in the case where N images are formed on N sheets in the fourth mode, the fourth execution time length ST4 is expressed by the following formula (16). However, the fourth and subsequent images are to be formed on one side of sheets.

$$T10=(L1+L3-L4)/S0 \tag{13}$$

$$T11=\mathrm{MAX}(Tp2-T10,Tc,Tw) \tag{14}$$

$$T12=(L1+L2+L3)/S1 \tag{15}$$

$$ST4=T4+T9+T10+T11+T12+Tp1*(N-2) \tag{16}$$

However, N is an integer that is equal to or larger than 2.

Figure 11:
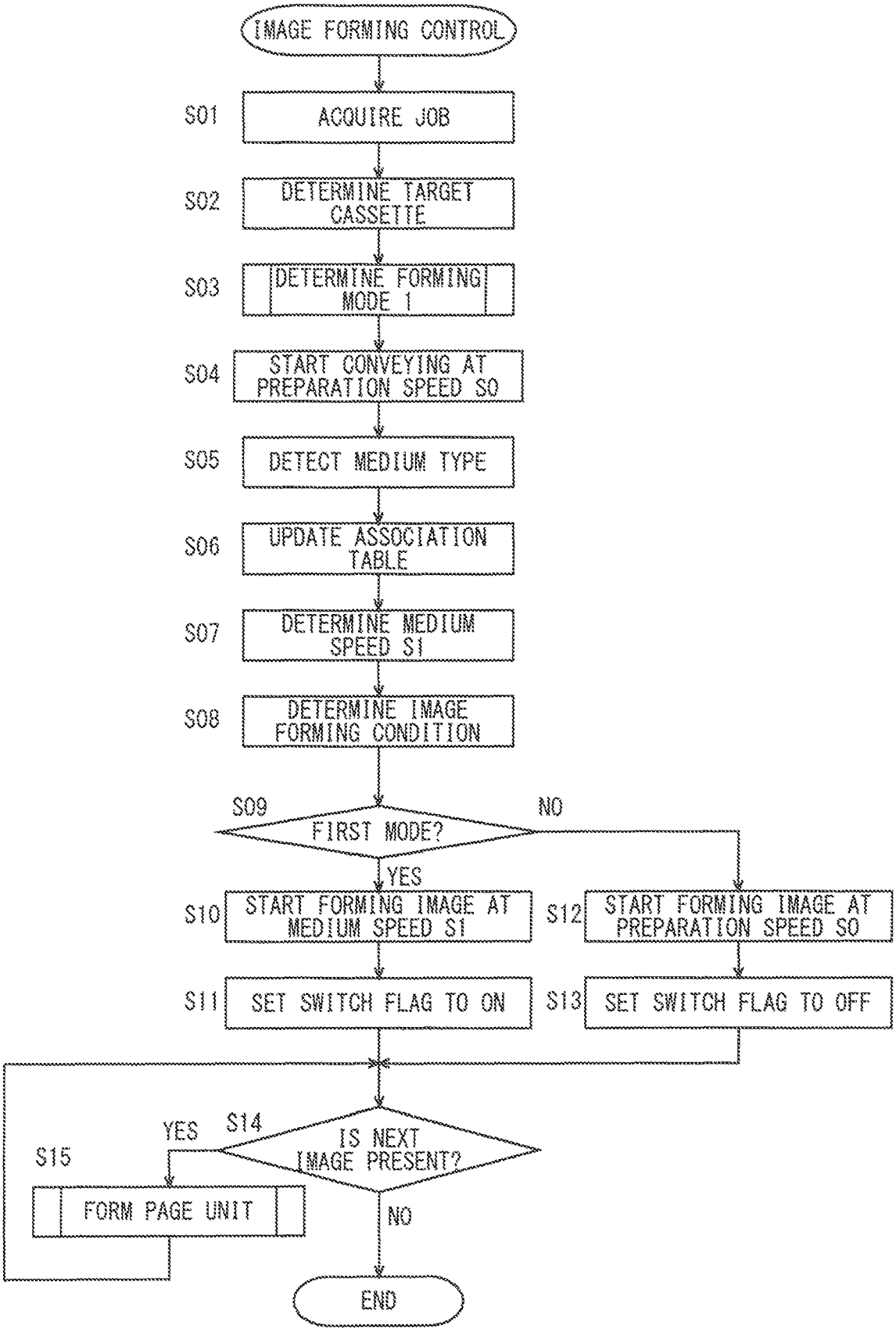
FIG. 11 is a flow chart showing one example of a flow of an image forming control process.

FIG. 11 is a flow chart showing one example of a flow of an image forming control process. The image forming control process is the process executed by the CPU 111 when the CPU 111 included in the MFP 100 executes an image forming program stored in the ROM 113, the HDD 115 or the CD-ROM 118A. Referring to FIG. 11, the CPU 111 acquires a job (step S01). Specifically, in the case where the user operates the operation unit 163, the CPU 111 acquires a print job input by the user in the operation unit 163 or a job specified by an execution instruction of a copy job. Further, when the communication I/F unit 112 receives a print job from an external computer, the CPU 111 acquires the received print job. Further, in the case where the MFP 100 is remotely operated by a portable device such as a smartphone, the communication I/F unit 112 communicates with a portable device. The CPU 111 acquires a print job or a copy job specified by a remote operation that is received by the communication I/F unit 112 from the portable device.

In the step S02, a target cassette is determined, and the process proceeds to the step S03. The target cassette is the cassette in which the sheet on which an image is to be formed is stored among the three paper feed cassettes 151, 152, 153 and the manual paper feed cassette 154. In the case where one of the paper feed cassettes 151, 152, 153 and the manual paper feed cassette 154 is designated by the job acquired in the step S01, the designated cassette is determined as a target cassette. Further, a default cassette out of the paper feed cassettes 151, 152, 153 and the manual feed cassette 154 may be determined as a target cassette.

In the step S03, a forming mode determining process is executed, and the process proceeds to the step S04. The forming mode determining process, which will be described below in detail, is the process of determining one of the first to fourth modes as the forming mode. In the step S04, the CPU 111 starts conveying the sheet stored in the target cassette at the preparation speed S0, and the process proceeds to the step S05. In this stage, the sheet is conveyed at the preparation speed S0 until its front end arrives at the timing roller 45.

In the step S05, the CPU 111 detects the medium type, and the process proceeds to the step S06. Specifically, the CPU 111 controls the detection device 59, detects the transmissivity TR and determines the medium type based on the transmissivity TR. The CPU 111 determines the basis weight corresponding to the transmissivity TR and determines the medium type corresponding to the basis weight. In the step S06, the association table is updated, and the process proceeds to the step 507. The association table is the table that associates the three paper feed cassettes 151, 152, 153 and the manual paper feed cassette 154 with the medium types of the recording media stored therein, and is stored in the HDD 115.

In the step 507, the medium speed S1 is determined as the image forming speed, and the process proceeds to the step S08. The medium speed S1 is the image forming speed that is predetermined with respect to a sheet of the medium type determined in the step S05. In the step S08, the image forming condition is determined, and the process proceeds to the step S09. The image forming condition is determined based on the medium type determined in the step S05 and the image forming speed defined by the forming mode determined in the step S03. Specifically, the voltage that is suitable for the medium type and the image forming speed and is to be applied to the transfer roller 47 and the temperature of the fuser roller 49 are determined.

In the step S09, the CPU 111 determines whether the forming mode determined in the step S03 is the first mode. If the forming mode is the first mode, the process proceeds to the step S10. If not, the process proceeds to the step S12. In the step S10, the image formation is started with the image forming speed set to the medium speed S1, and the process proceed to the step S11. An image is formed on the sheet at the medium speed S1 while the sheet is conveyed at the medium speed S1 from the timing roller 45. In the step S11, a switch flag is set to ON, and the process proceeds to the step S14. The switch flag is the flag indicating that the image forming speed has been switched from the preparation speed S0 to the medium speed S1. The switch flag is set to OFF in the case where the image forming speed is the preparation speed S0, and is set to ON in the case where the image forming speed is the medium speed S1.

In the step S12, the image formation is started with the image forming speed set to the preparation speed S0, and the process proceeds to the step S13. An image is formed on the sheet at the preparation speed S0 while the sheet is conveyed at the preparation speed S0 from the timing roller 45. In the step S13, the switch flag is set to OFF, and the process proceeds to the step S14.

In the step S14, the CPU 111 determines whether a next image is present. If the next image is present, the process proceeds to the step S15. If not, the process ends. In the step S15, the CPU 111 executes a page unit forming process, and the process returns to the step S14.

Figure 12:
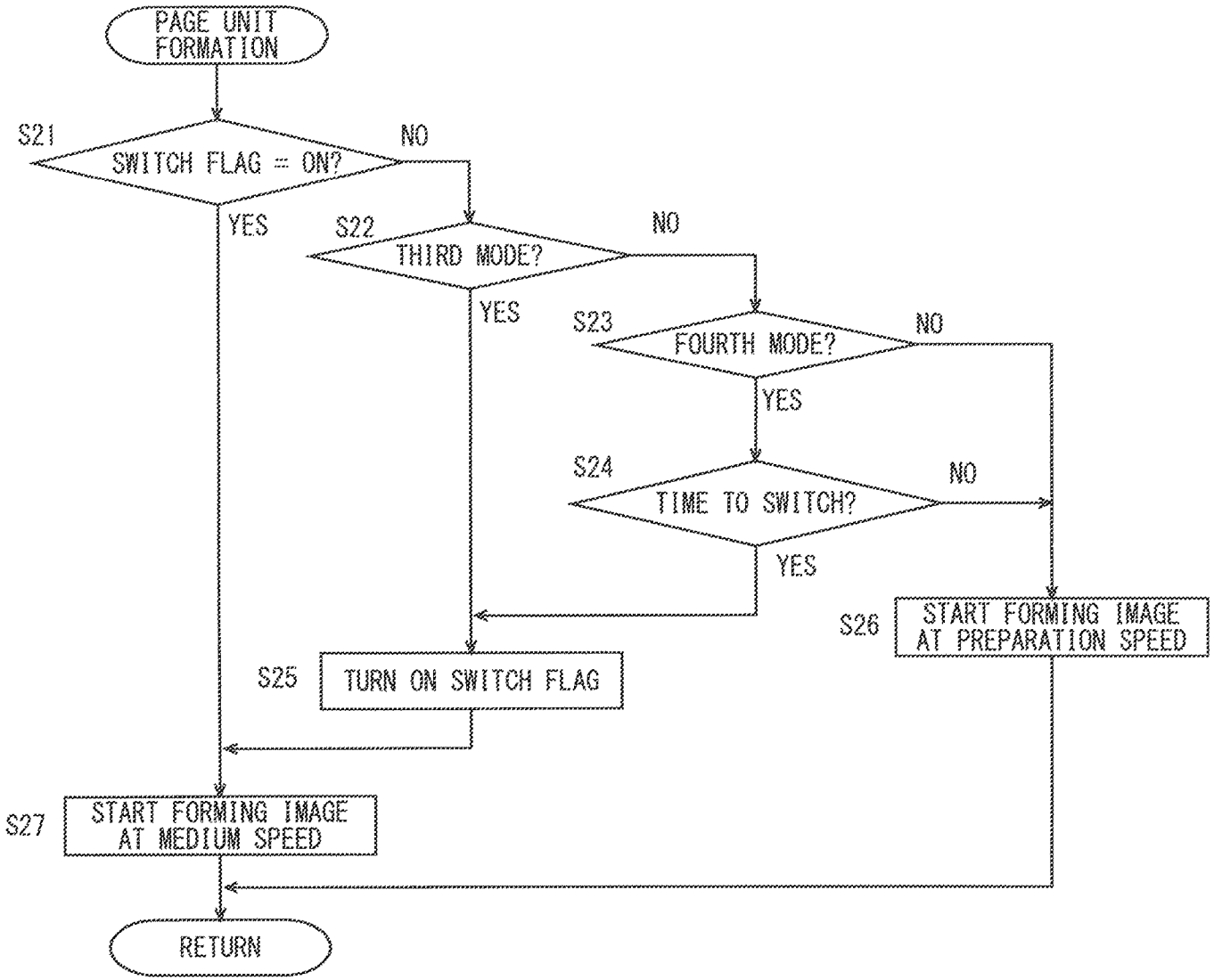
FIG. 12 is a flow chart showing one example of a flow of a page unit forming process.

FIG. 12 is a flow chart showing one example of a flow of the page unit forming process. Referring to FIG. 12, the CPU 111 determines whether the switch flag is set to ON (step S21). If the switch flag is set to ON, the process proceeds to the step S27. If not, the process proceeds to the step S22.

In the step S22, the CPU 111 determines whether the forming mode is the third mode. If the forming mode is the third mode, the process proceeds to the step S25. If not, the process proceeds to the step S23. In the step S25, the switch flag is switched to ON, and the process proceeds to the step S27. In the step S27, similarly to the step S10, the image formation is started at the medium speed S1, and the process returns to the image forming control process. In the case where the forming mode is the third mode, the second and subsequent images are formed at the medium speed S1. In the case where the forming mode is the third mode, the process proceeds from the step S22 to the step S25. In this case, the switch flag is set to ON, so that the second and subsequent images are formed at the medium speed S1.

In the step S23, the CPU 111 determines whether the forming mode is the fourth mode. If the forming mode is the fourth mode, the process proceeds to the step S24. If not, the process proceeds to the step S26. In the case where the process proceeds from the step S23 to the step S26, the forming mode is the second mode. In the step S26, the image formation is started at the preparation speed S0 similarly to the step S12, and the process returns to the image forming control process.

In the step S24, the CPU 111 determines whether now is a proper time for the switch. The CPU 111 determines the switch time point based on the time interval condition defined by the print condition. For example, in the case where the duplex printing is set in the print condition, the CPU 111 determines that the switch time point is between the formation of an image that is to be formed on the front side of the sheet and the formation of an image that is to be formed on the back side of the sheet. Therefore, in the case where an image is to be formed on the back side of a sheet, the CPU 111 determines that now is the switch time point. If now is the switch time point, the process proceeds to the step S25. If not, the process proceeds to the step S26. In the case where the process proceeds from the step S24 to the step S25, the switch flag is set to ON. Thus, the images to be formed past the switch time point are formed at the medium speed S1.

Figure 13:
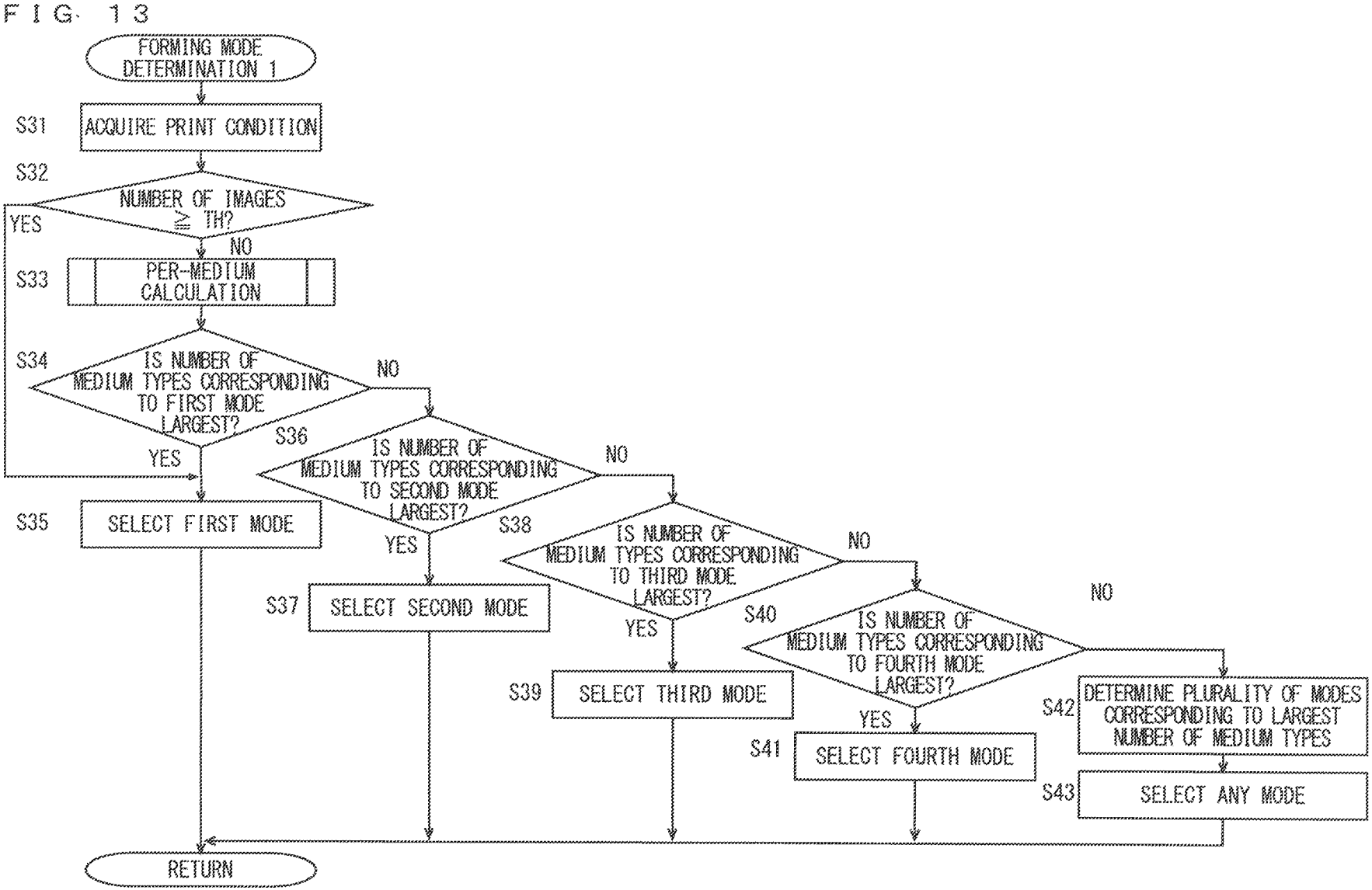
FIG. 13 is a flow chart showing one example of a flow of a forming mode determining process.

FIG. 13 is a flow chart showing one example of a flow of the forming mode determining process. The forming mode determination process is the process to be executed in the step S02 of FIG. 11. Referring to FIG. 13, the print condition is acquired (step S31), and the process proceeds to the step S32. The CPU 111 acquires the print condition defined by the job. In the step S32, the CPU 111 determines whether the number, that is defined by the print condition, of images to be formed is equal to or larger than a threshold value TH. If the number of images is equal to or larger than the threshold value TH, the process proceeds to the step S35. If not, the process proceeds to the step S33. In the step S35, the CPU 111 determines the first mode as the forming mode, and the process returns to the image forming control process.

In the step S33, a per-medium calculation process is executed, and the process proceeds to the step S33. The per-medium calculation process, which will be described below in detail, is the process of determining the forming mode with respect to each of the plurality of medium types. The number of the media types determined with respect to each of the first to fourth modes in the step S34, the step S36, the step S38 and the step S40 are compared to one another.

In the step S34, if the first mode is determined as the forming mode with respect to the largest number of medium types, the process proceeds to the step S35. If not, the process proceeds to the step S36. In the step S35, the CPU 111 determines the first mode as the forming mode, and the process returns to the image forming control process. In the step S36, if the second mode is determined as the forming mode with respect to the largest number of medium types, the process proceeds to the step S37. If not, the process proceeds to the step S38. In the step S37, the CPU 111 determines the second mode as the forming mode, and the process returns to the image forming control process.

In the step S38, if the third mode is determined as the forming mode with respect to the largest number of medium types, the process proceeds to the step S39. If not, the process proceeds to the step S40. In the step S39, the CPU 111 determines the third mode as the forming mode, and the process returns to the image forming control process. In the step S40, if the fourth mode is determined as the forming mode with respect to the largest number of medium types, the process proceeds to the step S41. If not, the process proceeds to the step S42. In the step S41, the CPU 111 determines the fourth mode as the forming mode, and the process returns to the image forming control process.

The process proceeds to the step S42 in the case where two or more forming modes are selected with respect to the largest number of medium types. In the step S42, the CPU 111 selects any forming mode from among the plurality of forming modes that are selected with respect to the largest number of medium types, and the process returns to the image forming control process.

Figure 14:
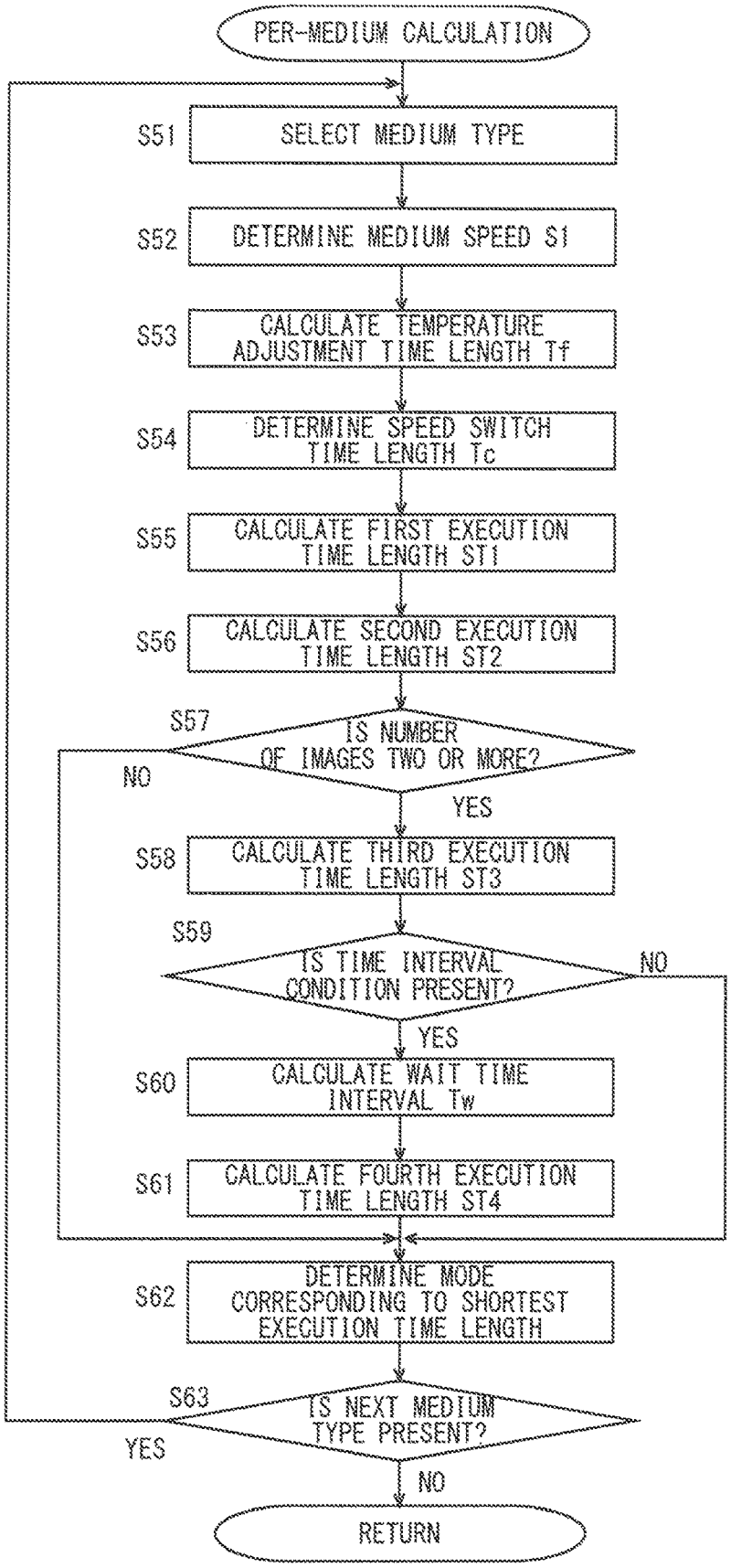
FIG. 14 is a flow chart showing one example of a flow of a medium type calculation process.

FIG. 14 is a flow chart showing one example of a flow of a per-medium calculation process. The per-medium calculation process is executed in the step S33 in the forming mode determination process. Referring to FIG. 14, the CPU 111 selects the medium type subject to the image formation (step S51). The CPU 111 selects one media type subject to the image formation from among the plurality of media types of the recording media on which an image can be formed by the MFP 100.

In the step S52, the CPU 111 determines the medium speed S1, and the process proceeds to the step S53. The CPU 111 determines the image forming speed that is predetermined with respect to the selected medium type subject to the image formation in the step S51 as the medium speed S1.

In the step S53, the CPU 111 calculates the temperature adjustment time length Tf, and the process proceeds to the step S54. The CPU 111 calculates the time length required for the temperature of the fuser roller 49 to change from the temporary temperature to the temperature suitable for the medium type as the temperature adjustment time length Tf. The temporary temperature is a predetermined temperature, and the temperature suitable for the medium type is the temperature predetermined with respect to the medium type selected in the step S51. The CPU 111 calculates the time length required for the temperature of the fuser roller 49 to change from the temporary temperature to the temperature suitable for the medium type using the conversion formula defining the relationship, which the temporary temperature and the temperature predetermined with respect to the medium type have with the temperature adjustment time length Tf. The CPU 111 may determine the temperature adjustment time length Tf using the table defining the relationship, which the temporary temperature and the temperature predetermined with respect to the medium type have with the temperature adjustment time length Tf.

In the step S54, the CPU 111 calculates the speed switch time length Tc, and the process proceeds to the step S54. For example, the CPU 111 calculates the speed switch time length Tc using the conversion formula defining the relationship between the preparation speed S0, the medium speed S1 and the speed switch time length Tc. The CPU 111 may determine the speed switch time length Tc using the table defining the speed switch time length Tc with respect to each medium type.

In the step S55, the CPU 111 calculates the first execution time length ST1 using the above-mentioned formula (4), and the process proceeds to the step S56. In the step S56, the CPU 111 calculates the second execution time length ST2 using the above-mentioned formula (8), and the process proceeds to the step S57.

In the step S57, the CPU 111 determines whether the number of images is two or more. The CPU 111 determines whether the number, that is defined by the print condition, of images to be formed is two or more. If the number of images is two or more, the process proceeds to the step S58. If not, the process proceeds to the step S62. In the step S58, the CPU 111 calculates the third execution time length ST3 using the above-mentioned formula (12), and the process proceeds to the step S59.

In the step S59, the CPU 111 determines whether the print condition, that is defined by the job, to be executed includes a time interval condition. If the time interval condition is included in the print condition, the process proceeds to the step S60. If not, the process proceeds to the step S62. In the step S60, the CPU 111 calculates the wait time interval Tw, and the process proceeds to the step S61. The wait time interval Tw is the time length that is set between the formation of respective two images, and is defined by the time interval condition. For example, in the case where the time interval condition is that the simplex printing is switched to the duplex printing, the CPU 111 calculates the time length during which the sheet on which the duplex printing is to be performed is conveyed through the inverting path 21 after an image is formed on the front side as the wait time interval Tw. Specifically, the CPU 111 calculates the wait time interval Tw by dividing the length of the inverting path 21 by the conveyance speed that is the same as the preparation speed S0, which is the image forming speed. In the step S61, the CPU 111 calculates the fourth execution time length ST4 using the above-mentioned formula (16), and the process proceeds to the step S62.

In the step S62, the CPU 111 determines the forming mode corresponding to the medium type that is selected in the step S51 as being subject to image formation, and the process proceeds to the step S63. In the case where the process proceeds from the step S57, the CPU 111 determines the mode, corresponding to the shortest execution time length between the first and second execution time lengths ST1, ST2, out of the first and second modes as the forming mode. In the case where the process proceeds from the step S59, the CPU 111 determines the mode, corresponding to the shortest execution time length among the first to third execution time lengths ST1 to ST3, out of the first to third modes as the forming mode. In the case where the process proceeds from the step S61, the CPU 111 determines the mode, corresponding to the shortest execution time length among the first to fourth execution time lengths ST1 to ST4, out of the first to fourth modes as the forming mode.

In the step S63, the CPU 111 determines whether the medium type, which is not selected in the step S51 as being subject to image formation, is present among the plurality of medium types. If an unselected medium type is present, the process returns to the step S51. If not, the process returns to the forming mode determining process.

MODIFIED EXAMPLE

An MFP 100 in the modified example counts the number of sheets on which images have been formed in the past with respect to each medium type, and determines the forming mode based on the medium type corresponding to the largest number of sheets on which images have been formed in the past.

Figure 15:
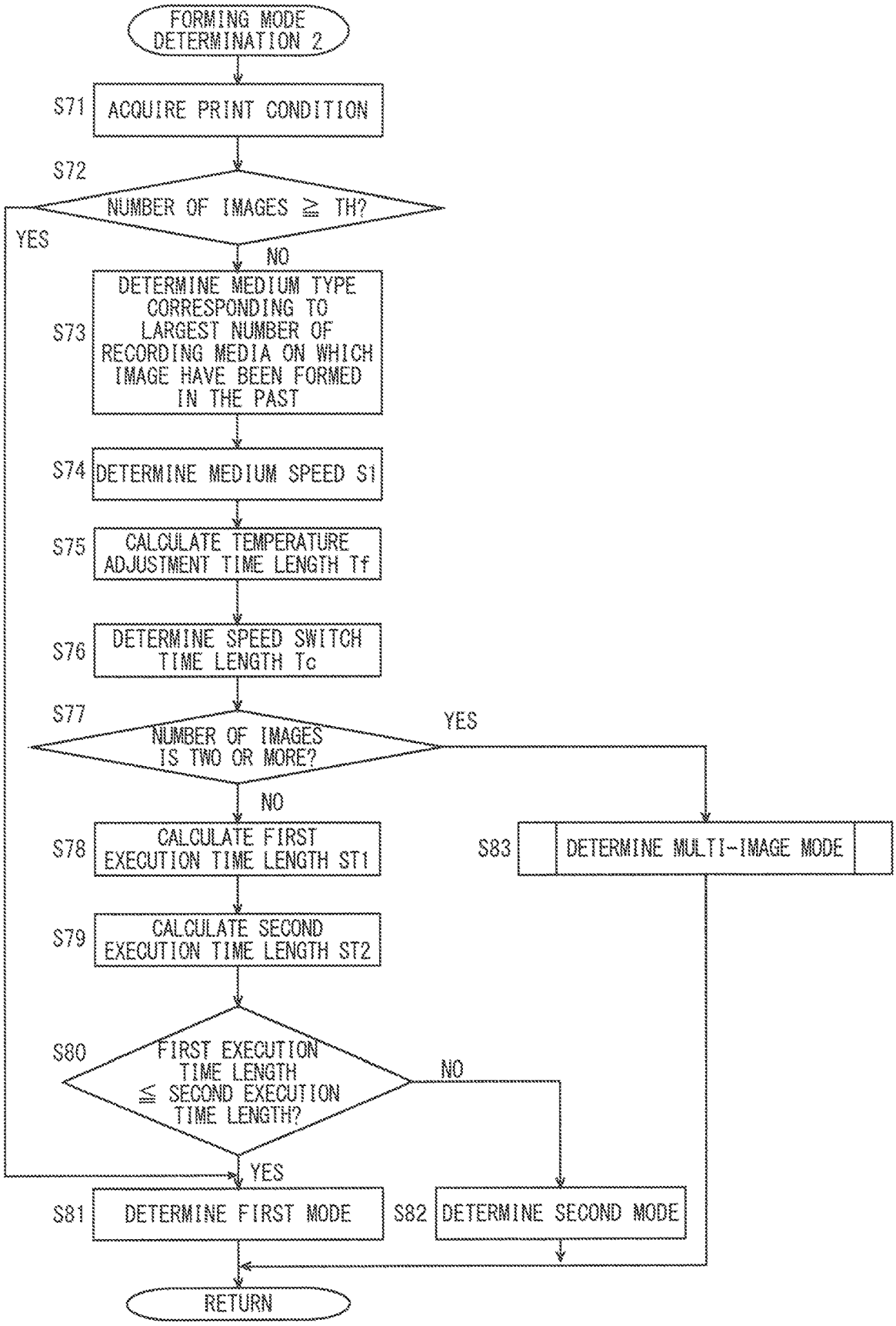
FIG. 15 is a flow chart showing one example of a flow of a forming mode determining process in a modified example.

FIG. 15 is a flow chart showing one example of a flow of a forming mode determining process in the modified example. The forming mode determining process in the modified example is the process executed in the step S02 of FIG. 11. Referring to FIG. 15, the CPU 111 acquires a print condition (step S71), and the process proceeds to the step S72. The CPU 111 acquires the print condition defined by a job. In the step S72, the CPU 111 determines whether the number, that is defined by the print condition, of images to be formed is equal to or larger than a threshold value TH. If the number of images is equal to or larger than the threshold value TH, the process proceed to the step S81. If not, the process proceeds to the step S73. In the step S81, the CPU 111 determines the first mode as the forming mode, and the process returns to the image forming control process.

In the step S73, the CPU 111 determines the medium type corresponding to the largest number of recording media on which images have been formed in the past. Then, the CPU 111 determines a medium speed S1 corresponding to the determined medium type (step S74), and the process proceeds to the step S75. In the step S75, the CPU 111 calculates a temperature adjustment time length Tf, and the process proceeds to the step S76. The CPU 111 calculates the time length required for the temperature of the fuser roller 49 to change from a temporary temperature to the temperature suitable for the medium type as the temperature adjustment time length Tf. In the step S76, the CPU 111 calculates a speed switch time length Tc, and the process proceeds to the step S77. For example, the CPU 111 calculates the speed switch time length Tc using the conversion formula defining the relationship between a preparation speed S0, a medium speed S1 and a speed switch time length Tc, for example.

In the step S77, the CPU 111 determines whether the number of images is two or more. If the number, that is defined by the print condition, of images to be formed is two or more, the process proceeds to the step S83. If not, the process proceeds to the step S78. In the step S83, the CPU 111 executes a multi-image mode determining process, and the process returns to an image forming control process.

In the step S78, the CPU 111 calculates a first execution time length ST1 using the above-mentioned formula (4), and the process proceeds to the step S79. In the step S79, the CPU 111 calculates a second execution time length ST2 using the above-mentioned formula (8), and the process proceeds to the step S80. In the step S80, the CPU 111 compares the first execution time length ST1 to the second execution time length ST2. If the first execution time length ST1 is equal to or shorter than the second execution time length ST2, the process proceeds to the step S81. If not, the process proceeds to the step S82. In the step S81, the CPU 111 determines the first mode as the forming mode, and the process returns to the image forming control process. In the step S82, the CPU 111 determines the second mode as the forming mode, and the process returns to the image forming control process.

Figure 16:
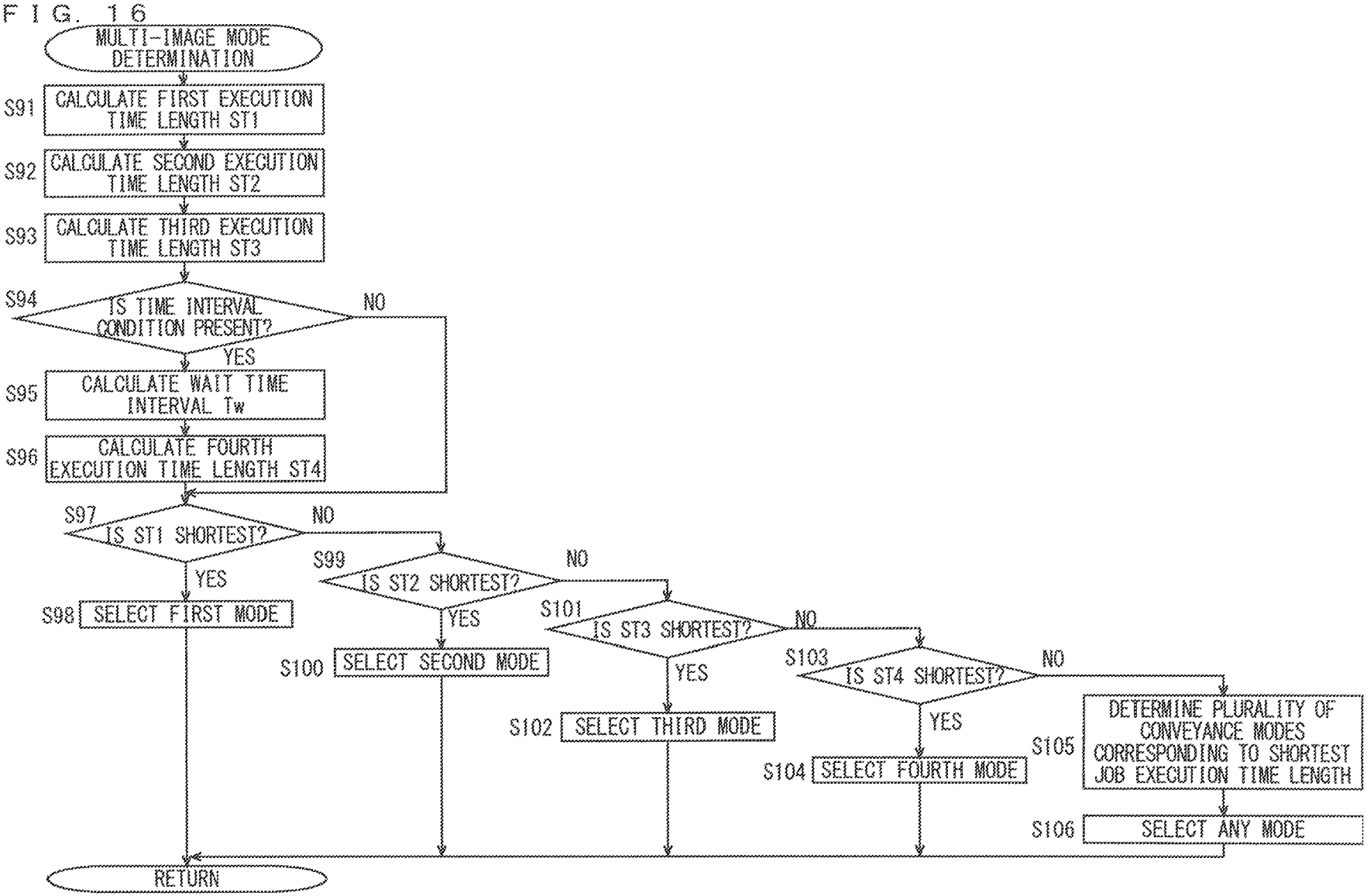
FIG. 16 is a flow chart showing one example of a flow of a multi-image mode determining process.

FIG. 16 is a flow chart showing one example of a flow of the multi-image mode determining process. The multi-image mode determining process is the process to be executed in the step S83 of FIG. 15. Referring to FIG. 16, the CPU 111 calculates the first execution time length ST1 (step S91) using the above-mentioned formula (4), and the process proceeds to the step S92. In the step S92, the CPU 111 calculates the second execution time length ST2 using the above-mentioned formula (8), and the process proceeds to the step S93. In the step S93, the CPU 111 calculates the third execution time length ST3 using the above-mentioned formula (12), and the process proceeds to the step S94.

In the step S94, the CPU 111 determines whether a print condition, that is defined by the job, to be executed includes a time interval condition. If the time interval condition is included in the print condition, the process proceeds to the step S95. If not, the process proceeds to the step S97. In the step S95, the CPU 111 calculates the wait time interval Tw, and the process proceeds to the step S96. In the step S96, the CPU 111 calculates a fourth execution time length ST4 using the above-mentioned formula (16), and the process proceeds to the step S97.

In the step S97, the CPU 111 determines whether the first execution time length ST1 is the shortest time length among the first to fourth execution time lengths ST1 to ST4. If the first execution time length ST1 is the shortest, the process proceeds to the step S98. If not, the process proceeds to the step S99. In the step S98, the CPU 111 determines the first mode as the forming mode, and the process returns to the image forming control process. In the step S99, the CPU 111 determines whether the second execution time length ST2 is the shortest time length among the first to fourth execution time lengths ST1 to ST4. If the second execution time length ST2 is the shortest, the process proceeds to the step S100. If not, the process proceeds to the step S101. In the step S100, the CPU 111 determines the second mode as the forming mode, and the process returns to the image forming control process. In the step S101, the CPU 111 determines whether the third execution time length ST3 is the shortest time length among the first to fourth execution time lengths ST1 to ST4. If the third execution time length ST3 is the shortest, the process proceeds to the step S102. If not, the process proceeds to the step S103. In the step S102, the CPU 111 determines the third mode as the forming mode, and the process returns to the image forming control process. In the step S103, the CPU 111 determines whether the fourth execution time length ST4 is the shortest time length among the first to fourth execution time lengths ST1 to ST4. If the fourth execution time length ST is the shortest, the process proceeds to the step S104. If not, the process proceeds to the step S105. In the step S104, the CPU 111 determines the fourth mode as the forming mode, and the process returns to the image forming control process.

The process proceeds to the step S105 in the case where the number of forming modes corresponding to the shortest execution time length is two or more. In the step S105, the CPU 111 determines any forming mode out of the plurality of forming modes corresponding to the shortest job execution time length as the forming mode, and the process returns to the image forming control process.

As described above, before an image is formed on a sheet by the image forming unit 140, the MFP 100 in the present embodiment determines the medium type of the sheet. Further, before the medium type is determined, the MFP 100 in the present embodiment determines whether to set the medium speed S1 as the image forming speed after the medium type is determined. Therefore, the CPU 111 can select the case corresponding to the shortest time length from the start until the end of the image formation between the case where the image forming unit 140 waits until being capable of forming an image on a sheet at the medium speed S1 and then forms an image, and the case where the image forming unit 140 does not wait until being capable of forming an image at the preparation speed S0 and forms an image at the preparation speed S0. As a result, a throughput time from the time when the user gives an instruction to execute a job until the end of execution of the job can be shortened.

Further, the CPU 111 estimates the first to fourth execution time lengths ST1 to ST4 as the execution time lengths during which images are respectively formed on sheets of a plurality of medium types with respect to the respective first to fourth modes in which the images are formed at different image forming speeds after the medium types of the sheets are determined, and determines the forming mode corresponding to the largest ratio of the number of medium types corresponding to the shortest execution time length to the number of the other medium types among the first to fourth modes as the forming mode. Therefore, before the medium type of the sheet is determined, the probability of selecting the forming mode suitable for the medium type of the sheet can be increased.

Further, the MFP 100 estimates the first to fourth execution time lengths ST1 to ST4 based on the speed switch time length Tc required for the MFP 100 to be in a state of being capable of forming an image on a sheet at the medium speed S1, thereby being capable of estimating the first to fourth execution time lengths ST1 to ST4.

Further, the MFP 100 estimates the first to fourth execution time lengths ST1 to ST4 based on the temperature adjustment time length Tf required for the temperature of the fuser roller 49 to change to the temperature suitable for the medium type of the sheet, thereby being capable of accurately estimating the first to fourth execution time lengths ST1 to ST4.

Further, the MFP 100 starts forming an image on a sheet at the time point at which the sheet arrives at the fuser roller 49 after the temperature of the fuser roller 49 changes to the temperature suitable for the medium type of the sheet. Thus, a toner image to be formed on the sheet can be fused at an appropriate temperature, and the image quality can be prevented from being degraded.

Further, in the case where the first mode is determined as the forming mode, the MFP 100 conveys a sheet along the second conveyance path at the medium speed S1, which is the image forming speed. In the case where the second mode is determined as the forming mode, the MFP 100 conveys a sheet along the second conveyance path at the conveyance speed that is the same as the preparation speed S0, which is the image forming speed. Therefore, the MFP 100 can convey a sheet while being in sync with the image forming unit 140.

Further, in the case where estimating the third execution time length ST3 corresponding to the third mode, the MFP 100 estimates the third execution time length ST3 based on the longer time length between the time interval from the end of the formation of the first image to the start of the formation of the second and subsequent images and the speed switch time length Tc required for the image forming unit 140 to change to the state of being capable of forming an image at the medium speed S1. Thus, the third execution time length ST3 can be as short as possible.

Further, in the case where estimating the fourth execution time length ST4 corresponding to the fourth mode, the MFP 100 estimates the fourth execution time length ST4 based on the longer time length between the wait time interval Tw and the speed switch time length Tc required for the image forming unit 140 to change to the state of being capable of forming an image at the medium speed S1. Thus, the image forming unit 140 can change to the state of being capable of forming an image at the medium speed S1 during the wait time interval Tw, and the fourth execution time length ST4 corresponding to the fourth mode can be as short as possible.

Further, in the case where the number of images is equal to or larger than the threshold value TH, the MFP 100 determines the medium speed S1 as the image forming speed after the medium type is determined. Thus, the job execution time length can be short.

Further, the MFP 100 forms an image on a sheet on an image forming condition corresponding to the medium type of the sheet and an image forming speed, thereby being capable of preventing the image quality of the image to be formed on the sheet from being degraded.

Further, the MFP 100 in the modified example estimates the first to fourth execution time lengths ST1 to ST4 as the execution time lengths for the respective first to fourth modes with respect to the medium type corresponding to the largest number of sheets of the recording medium on which images have been formed in the past, and determines the mode corresponding to the shortest execution time length among the first to fourth modes as the forming mode. The user is likely to, in the future, use the recording medium of the medium type corresponding to the largest number of sheets on which images have been formed in the past. Thus, before the medium type of the sheet is determined, the probability of selection of the forming mode suitable for the medium type of the sheet can be increased.

Although embodiments of the present invention have been described and illustrated in detail, the disclosed embodiments are made for purpose of illustration and example only and not limitation. The scope of the present invention should be interpreted by terms of the appended claims

What is claimed is:

1. An image forming apparatus comprising:

an image former configured to form an image on a recording medium; and a hardware processor, wherein the hardware processor, before the image is formed on the recording medium by the image former, determines a medium type of a subject medium that is the recording medium on which the image is to be formed by the image former, and before the medium type of the subject medium is determined, determines whether an image forming speed at which the image former forms the image is a medium speed that is predetermined with respect to the medium type of the subject medium.

2. The image forming apparatus according to claim 1, wherein the hardware processor further, with respect to each of a plurality of modes respectively corresponding to different image forming speeds after the medium type of the subject medium is determined, estimates an execution time length during which the image is formed on the subject medium of each of a plurality of medium types, and determines one of the plurality of modes as a forming mode in which the image former forms the image based on a ratio of the number of medium types corresponding to a shortest execution time length to the number of other medium types.

3. The image forming apparatus according to claim 1, wherein the hardware processor further, with respect to each of a plurality of modes respectively corresponding to different image forming speeds after the medium type of the subject medium is determined, estimates an execution time length during which the image is formed on the subject medium of a medium type corresponding to a largest number of times images have been formed in the past among a plurality of medium types, and determines one mode that corresponds to a shortest execution time length from among the plurality of modes as a forming mode in which the image former forms the image.

4. The image forming apparatus according to claim 2, wherein the hardware processor estimates the execution time length based on a speed switch time length required for the image former to change to a state of being capable of forming the image on a subject medium at the medium speed.

5. The image forming apparatus according to claim 2, further comprising a fuser device that fuses an image on a sheet, wherein the hardware processor estimates the execution time length based on a temperature adjustment time length required for the fuser device to change to a state defined by the determined medium type.

6. The image forming apparatus according to claim 5, wherein the image former starts forming the image at a time point at which the subject medium arrives at the fuser device after the fuser device changes to the state defined by the determined medium type.

7. The image forming apparatus according to claim 2, wherein the plurality of modes includes a first mode in which the image is formed at the medium speed after the medium type of the subject medium is determined, and a second mode in which the image is formed at a preparation speed that is same as a conveyance speed at which the subject medium is conveyed before the medium type of the subject medium is determined.

8. The image forming apparatus according to claim 7, further comprising a conveyance device that conveys a recording medium along a first conveyance path arranged at a position farther upstream than the image former and a second conveyance path arranged at a position farther downstream than the first conveyance path, wherein the conveyance device, in the case where the first mode is determined as the forming mode, conveys the subject medium at a conveyance speed that is same as the medium speed along the second conveyance path, and in the case where the second mode is determined as the forming mode, conveys the subject medium along the second conveyance path at a conveyance speed that is same as the preparation speed.

9. The image forming apparatus according to claim 7, wherein the plurality of modes further include a third mode in which, in the case where a print condition that a plurality of images are to be formed is defined, after the medium type of the subject medium is determined, a first image is formed at the preparation speed, and second and subsequent images are formed at the medium speed, and the hardware processor determines one of the first mode, the second mode and the third mode as the forming mode.

10. The image forming apparatus according to claim 9, wherein the hardware processor, in the case where estimating the execution time length corresponding to the third mode, estimates the execution time length based on a longer time length between a time interval from an end of formation of the first image until a start of formation of second and subsequent images and a speed switch time length required for the image former to change to a state of being capable of forming the image at the medium speed.

11. The image forming apparatus according to claim 9, wherein the plurality of modes includes a fourth mode in which, in the case where the print condition includes a time interval condition that at least one wait time interval among time intervals provided in formation of a plurality of images is to be longer than other time intervals, images that are formed before the wait time interval are formed at the preparation speed, and images that are formed after the wait time interval are formed at the medium speed, and the hardware processor determines one of the first mode, the second mode, the third mode and the fourth mode as a forming mode.

12. The image forming apparatus according to claim 11, wherein the hardware processor, in the case where estimating the execution time length corresponding to the fourth mode, estimates the execution time length based on a longer time length between the wait time interval and a speed switch time length required for the image former to change to a state of being capable of forming the image at the medium speed.

13. The image forming apparatus according to claim 11, wherein the time interval condition includes a condition that images are to be formed on both sides of a recording medium.

14. The image forming apparatus according to claim 1, wherein the hardware processor, in the case where the number of images to be formed by the image former is equal to or larger than a predetermined number, after a medium type of the subject medium is determined, determines the medium speed as the image forming speed.

15. The image forming apparatus according to claim 1, wherein the image former forms the image on the subject medium on an image forming condition corresponding to a medium type and the image forming speed determined by the hardware processor.

16. An image forming method that is performed in an image forming apparatus, the image forming apparatus comprising an image former configured to form an image on a recording medium, and the image forming method including:

a medium type determining step of, before the image is formed on the recording medium by the image former, determining a medium type of a subject medium that is the recording medium on which the image is to be formed by the image former; and a forming mode determining step of, before the medium type of the subject medium is determined, determining whether to set a medium speed that is predetermined with respect to the medium type of the subject medium as an image forming speed at which the image former forms the image.

17. A non-transitory computer-readable recording medium encoded with an image forming program executed by a computer that controls an image forming apparatus, the image forming apparatus comprising an image former configured to form an image on a recording medium, wherein the computer that executes the image forming program, before the image is formed on the recording medium by the image former, determines a medium type of a subject medium that is the recording medium on which the image former forms the image, and before the medium type of the subject medium is determined, determines whether to set a medium speed that is predetermined with respect to the medium type of the subject medium as an image forming speed at which the image former forms the image.

* * * * *